US012123112B2

(12) United States Patent
Gupta

(10) Patent No.: US 12,123,112 B2
(45) Date of Patent: Oct. 22, 2024

(54) METHOD FOR MANUFACTURING A MULTI-PLY SEPARABLE FILAMENT YARNS AND MULTI-PLY SEPARABLE TEXTURED YARN

(71) Applicant: Ronak Rajendra Gupta, Mumbai (IN)

(72) Inventor: Ronak Rajendra Gupta, Mumbai (IN)

( * ) Notice: Subject to any disclaimer, the term of this patent is extended or adjusted under 35 U.S.C. 154(b) by 120 days.

(21) Appl. No.: 16/717,073

(22) Filed: Dec. 17, 2019

(65) Prior Publication Data

US 2020/0190709 A1 Jun. 18, 2020

Related U.S. Application Data

(62) Division of application No. 15/531,281, filed as application No. PCT/IB2016/058010 on Dec. 27, 2016.

(51) Int. Cl.
*D02J 1/08* (2006.01)
*D01D 5/088* (2006.01)
(Continued)

(52) U.S. Cl.
CPC ..... *D02J 1/08* (2013.01); *D01D 5/088* (2013.01); *D02G 1/0206* (2013.01); *D02G 1/0213* (2013.01); *D02G 1/022* (2013.01); *D02G 1/026* (2013.01); *D02G 1/08* (2013.01); *D02G 1/18* (2013.01); *D02G 3/36* (2013.01); *D02J 1/02* (2013.01); *D03D 1/00* (2013.01); *D03D 13/00* (2013.01); *D03D 13/008* (2013.01); *D03D 15/49* (2021.01); *D03D 1/0017* (2013.01);
(Continued)

(58) Field of Classification Search
CPC .. D02J 1/08; D01D 5/088; D02G 1/08; D02G 1/18; D02G 1/22; D02G 1/02; D01B 2331/02
See application file for complete search history.

(56) References Cited

U.S. PATENT DOCUMENTS 2,985,995 A 5/1961 Bunting, Jr.
3,110,151 A 11/1963 Bunting, Jr. et al.
(Continued)

FOREIGN PATENT DOCUMENTS

CN 105970315 A 9/2016
DE 2508567 A * 10/1975 ..... D02G 1/06
(Continued)

OTHER PUBLICATIONS

Cannon, C.G., 21-Filament Deformations in Simultaneous Draw-Texturing by the False-Twist Method, Journal of the Textile Institute 6:243-252 (1979).
(Continued)

*Primary Examiner* — Lynda Salvatore

(57) ABSTRACT

A method of manufacturing multi-ply separable textured yarn, the method comprising, passing a multi-ply separable interlaced filament yarn through a texturizing unit to form a multi-ply separable draw textured yarn, wherein the multi-ply separable interlaced filament yarn is separable in to at least two separable interlaced filament yarn, wherein the interlacing of the filaments within each separable interlaced filament yarn is retained during further processing of the yarn to fabric and in the fabric.

4 Claims, 22 Drawing Sheets

(51) Int. Cl.

| | |
|---|---|
| ***D02G 1/02*** | (2006.01) |
| ***D02G 1/08*** | (2006.01) |
| ***D02G 1/18*** | (2006.01) |
| ***D02G 3/36*** | (2006.01) |
| ***D02J 1/02*** | (2006.01) |
| ***D03D 1/00*** | (2006.01) |
| ***D03D 13/00*** | (2006.01) |
| ***D03D 15/47*** | (2021.01) |
| ***D03D 15/49*** | (2021.01) |

(52) U.S. Cl.
CPC ..... *D03D 15/47* (2021.01); *D10B 2331/02* (2013.01); *D10B 2331/04* (2013.01); *D10B 2503/06* (2013.01)

(56) References Cited

U.S. PATENT DOCUMENTS

| | | | | |
|---|---|---|---|---|
| 3,364,537 | A † | 1/1968 | William, Jr. | |
| 3,720,984 | A † | 3/1973 | Roberson, Jr. | |
| 3,911,538 | A | 10/1975 | Vidal et al. | |
| 3,999,361 | A | 12/1976 | Ellis et al. | |
| 4,069,564 | A † | 1/1978 | Trifunovic | |
| 4,069,565 | A | 1/1978 | Negishi et al. | |
| 4,070,817 | A | 1/1978 | Bueb et al. | |
| 4,439,903 | A | 4/1984 | Matsumoto et al. | |
| 4,464,894 | A | 8/1984 | Leininger | |
| 4,596,115 | A | 6/1986 | Maeda et al. | |
| 4,897,989 | A | 2/1990 | Gray | |
| 5,172,459 | A | 12/1992 | Goineau | |
| 5,640,745 | A | 6/1997 | Bertsch et al. | |
| 5,665,293 | A † | 9/1997 | Karageorgiou | |
| 5,675,878 | A | 10/1997 | Brown et al. | |
| 5,996,328 | A | 12/1999 | King et al. | |
| 6,029,328 | A | 2/2000 | Ballarati | |
| 6,447,703 | B1 * | 9/2002 | Waddington | D01D 5/16 264/103 |
| 6,481,072 | B1 | 11/2002 | Hoover et al. | |
| 6,890,166 | B2 | 5/2005 | Kirchhoff | |
| 7,086,130 | B2 | 8/2006 | Jahns et al. | |
| 7,249,451 | B2 | 7/2007 | Guidici | |
| 7,585,440 | B2 | 9/2009 | Marlow | |
| 8,261,526 | B2 | 9/2012 | Grassi et al. | |
| 8,317,826 | B2 | 11/2012 | Park | |
| 9,131,790 | B2 | 9/2015 | Argarwal | |
| 9,428,848 | B2 † | 8/2016 | Weigend | |
| 9,474,395 | B2 | 10/2016 | Garg | |
| 9,481,950 | B2 | 11/2016 | Argarwal | |
| 9,493,892 | B1 | 11/2016 | Agarwal | |
| 2011/0133011 | A1 * | 6/2011 | Lee | B65H 54/026 242/166 |
| 2012/0132309 | A1 | 5/2012 | Morris | |
| 2013/0291286 | A1 | 11/2013 | Stuckey et al. | |
| 2013/0298519 | A1 | 11/2013 | Smith et al. | |
| 2015/0259831 | A1 | 9/2015 | Journee | |
| 2016/0177478 | A1 | 6/2016 | Argarwal | |
| 2016/0194791 | A1 | 7/2016 | Argarwal | |
| 2016/0298270 | A1 | 10/2016 | Beavers et al. | |
| 2017/0016153 | A1 | 1/2017 | Argarwal | |
| 2017/0306533 | A1 | 10/2017 | Gupta | |

FOREIGN PATENT DOCUMENTS

| | | | |
|---|---|---|---|
| JP | S52-27846 | A | 3/1977 |
| JP | H02234940 | A | 9/1990 |
| JP | 07189065 | | 7/1995 |
| JP | 3016837 | B2 | 3/2000 |
| KR | 10-2005096575 | | 10/2005 |
| KR | 20050096575 | A | 9/2006 |
| KR | 10-0988986 | † | 10/2010 |
| KR | 20040118364 | A | 10/2010 |
| KR | 10-1430303 | † | 8/2014 |
| WO | WO 2013164791 | | 7/2013 |

OTHER PUBLICATIONS

Demiur and Behery, Synthetic Filament Yarn Texturing Technology, Upper Saddle River, New Jersey, Prentice Hall 1997.

Guoming, "Polymer Material Processing Technology, Ninth Five Year" Ministry-level Key Textbook for Textile Higher Education, China Textile Publishing House, Jul. 2000, 9 pages (with English translation).

1st Chinese Office Action, regarding Application No. 201680084944.0, dated Oct. 20, 2020, 27 pages (with English translation).

2nd Chinese Office Action, regarding Application No. 201680084944.0, dated Jun. 21, 2021, 9 pages (in Chinese).

European Patent Office Communication Pursuant to Rule 164(1) EPC, regarding Patent Application No. 16900338.1, PCT/IB2016058010, dated Nov. 4, 2019, 21 pages.

European Patent Office Communication, regarding Patent Application No. 16900338.1, PCT/IB2016058010, dated Feb. 6, 2020, 16 pages.

* cited by examiner
† cited by third party

Table

| FINAL DTY Product | 20 denier 2 Ply Parallel/Separable Texturise Yarn | | | | 20 denier 4 Ply Parallel/Separable Texturise Yarn | | | | 10 denier 4 Ply Parallel/Separable Texturise Yarn | | |
|---|---|---|---|---|---|---|---|---|---|---|---|
| Method Used - Column Identification | Conventional - 7A1 | Present Disclosure - 7A2 | Present Disclosure - 7A3 | Present Disclosure - 7A4 | Conventional - 7B1 | Present Disclosure - 7B2 | Present Disclosure - 7B3 | Present Disclosure - 7B4 | Conventional - 7C1 | Present Disclosure - 7C2 | Present Disclosure - 7C3 |
| SPINNING PRODUCTION : | | | | | | | | | | | |
| Reference Figure | Prior Art | Figure 4 | Figure 4A,4B,4C | Figure 5A | Figure 1 | Figure 4A,4B,4C | Figure 5B | Figure 5C | Figure 1 | Figure 5B | Figure 5C |
| Machine Changes | No Change | No Change | No Change | Increase Jets 2 times | No Change | No Change | Increase Jets 2 times | Increase Jets 4 times | No Change | Increase Jets 2 times | Increase Jets 4 times |
| Intermingling done on SPINNING machine | Low/NO | High | High | High | Low/NO | High | High | High | Low/NO | High | High |
| Denier of Each Filament Yarn Ply | 32 | 32 | 32 | 32 | 32 | 32 | 32 | 32 | 16 | 16 | 16 |
| Number of Ply in Multi-Ply Separable Filament Yarn | 1(Not Separable) | 1 | 2 | 2 | 1(Not Separable) | 2 | 4 | 4 | NA | 4 | 4 |
| Total Denier of Multi-Ply Separable Filament Yarn | 32 | 32 | 64 | 64 | 32 | 64 | 128 | 128 | NA | 64 | 64 |
| Number of Filament Yarn Packages Wound in Winder | 16 | 16 | 5 | 16 | 16 | 5 | 3 | 16 | NA | 3 | 16 |
| POY Production per Line per day in Kgs | 153.6 | 153.6 | 153.6 | 307.2 | 153.6 | 153.6 | 307.2 | 614.4 | 0 | 153.6 | 307.2 |
| DTY PRODUCTION USING ABOVE FILAMENT YARN : | | | | | | | | | | | |
| Reference Figure | Figure 6A | Figure 6C | Figure 6B | Figure 6B | Figure 6A | Figure 6C | Figure 6B | Figure 6B | Figure 6A | Figure 6B | Figure 6B |
| Yarn from Filament Yarn Package per spindle | 1 | 2 | 1 | 1 | 1 | 2 | 1 | 1 | 1 | 1 | 1 |
| Intermingling done on Texturising machine | High | Low/NO | Low/NO | Low/NO | High | Low/NO | Low/NO | Low/NO | High | Low/NO | Low/NO |
| Denier of Each DTY Ply | 20 | 20 | 20 | 20 | 20 | 20 | 20 | 20 | 10 | 10 | 10 |
| Number of DTY Ply in Multi-Ply Separable DTY | 2 | 2 | 2 | 2 | 4 | 4 | 4 | 4 | 4 | 4 | 4 |
| Total Denier of Multi-Ply Separable DTY Package | 40 | 40 | 40 | 40 | 80 | 80 | 80 | 80 | 40 | 40 | 40 |
| Number of DTY Bobbins Wound in Machine | 156 | 312 | 312 | 312 | 78 | 312 | 312 | 312 | 78 | 312 | 312 |
| DTY Production per Machine per day in Kgs | 748.8 | 1497.6 | 1497.6 | 1497.6 | 748.8 | 2995.2 | 2995.2 | 2995.2 | 374.4 | 1497.6 | 1497.6 |
| Comments | Normal Production of POY and DTY | DTY Production Doubled | DTY Production Doubled | POY and DTY Production Doubled | Normal POY and DTY Production | Yarn from 2 Packages per spindle fed on DTY Machine and Production Quadrupled | POY production Doubled and DTY Production Quadrupled | POY production Quadrupled and DTY Production Quadrupled | POY production not possible as assumed that Melt pump can spin min 32 Denier and minimum line capacity is 150 kgs per day | POY production Possible and DTY Production Quadrupled | POY Production Possible and doubled and DTY Production Quadrupled |

Assumptions in Table Examples :

a) Filament Yarn POY is Produced on a Spinning Line b) Polymer - Polyester Semidull c) Spinning Line has 1 Winder having capacity to wind 16 Bobbins at a time, Process Speed is 3000 Meters per minute d) DTY Machine has 312 Spindles and winding positions and Process Speed is 750 Meters per minute

FIGURE 7

METHOD FOR MANUFACTURING A MULTI-PLY SEPARABLE FILAMENT YARNS AND MULTI-PLY SEPARABLE TEXTURED YARN

CROSS-REFERENCE TO RELATED APPLICATIONS

The present application is a divisional of application Ser. No. 15/531,281 filed Mar. 26, 2017 which claims priority to International Application No. PCT/IB2016/058010, filed Dec. 27, 2016, which claims priority to Indian Patent Application No. 201621014375, which was filed on Apr. 25, 2016, which are both herein incorporated by reference in their entirety.

TECHNICAL FIELD

The present disclosure relates to the field of textiles. More particularly, the present disclosure relates to multi-ply separable filament yarns and multi-ply separable textured yarns and a method to manufacture it.

BACKGROUND

Textile manufacturing industry includes conversion of fiber or filaments into yarn and from yarn to fabric that is further processed.

Conventionally, filament yarn is produced by melting and extrusion of polymer chips in an extruder or directly from polymer melt coming from a continuous polymerization plant. Polymer may be a polyester, polyamide, polypropylene, polytrimethylene terephthalate, Polybutylene terephthalate, etc. Polymer melt is pressed through holes in spinnerets to form streams that are quenched to form filaments. The filaments are grouped to form a filament yarn with desired evenness, strength, shrinkage, elongation and other properties. During the processing, the filament yarns may be oriented or drawn to form low, medium, partially, high, fully oriented or fully drawn yarn.

The filament yarns are put through an additional process called texturing or texturizing ("Texturizing Process") to give texture, crimp, bulk, strength to the filament yarn and to vary its look and feel. Textured filament yarn includes draw textured yarn and air textured yarn (together "DTY") etc. In the texturizing process, the filament yarn is given an texture either by false twising in an fasle twist unit wherein twisting and detwisting takes place or by an fluid like air. Textured yarn is mainly used in weaving & knitting of fabrics for making clothes outer/inner garments, skin-clinging garments, home furnishings, seat covers, bags upholstery, bed sheets and many other uses.

"Plying" is done by taking two or more strands of yarn (filament yarn or a textured yarn) and putting them together.

"Multi-ply yarns" as referred herein are basically two or more yarns plyed together. Each yarn in the multi-ply may be referred to as a ply. Multi-ply yarns may be untwisted or unplyed to an individual ply.

"Interlaced yarns": The yarns during processing may be passed through interlacing jets to interlace the filaments within the yarn. Such yarns are referred herein as "Interlaced yarns". Interlacing helps to bind the filaments within the yarns.

"Separable interlaced yarn" as referred herein is a single ply interlaced yarn and that can be split/unplyed from the multi-ply yarns.

"Non-separable yarn" as referred herein is single ply yarn that cannot be split/unplyed from the multi-ply yarns.

"Multi-ply separable interlaced filament yarn" as referred herein is a multi-ply yarn that is separable in to at least two separable interlaced filament yarn, wherein the interlacing of the filaments within each separable interlaced filament yarn is retained during further processing of the yarn to fabric and in the fabric.

"Multi-ply separable textured yarn" as referred herein is a multi-ply yarn that is separable in to at least two separable interlaced textured yarn, wherein the interlacing of the filaments within each separable interlaced draw textured yarn is retained during further processing of the yarn to fabric and in the fabric.

Separable interlaced yarns are used amongst other in bed sheets wherein fine and super fine separable interlaced yarns are used to increase the thread count of the fabric.

Thread count is the number of threads woven into one square inch of fabric. This number is based on the threads woven horizontally ("weft") and vertically ("warp"). Weft insertions in an fabric are called as "picks". Thread count is increased by using multi-ply separable draw textured yarns and inserting in the weft. For example a Thread count of 1100 could be formed by taking 200 yarns per inch of any material in the warp say 50s cotton and inserting in weft 75 picks per inch in the weft and each pick will have 12 ply separable textured yarn. So the weft would have 900 (75*12) yarns per inch and total thread count is 1100(900+200). Accordingly the warp may also have multi-ply separable yarns to achieve very high thread counts.

For manufacturing multi-ply separable draw textured yarn in conventional processes, filament yarn is fed through a feed roller and passed through a heater, cooling plate and a false-twist unit having disks where the twisting and de-twisting, also known as false twisting takes place at a high speed. The yarn is further passed through an intermediate roller or a 'draw roller'. The draw roller draws the yarn while it is heated in the primary heater and getting twisted and de-twisted in the false-twist unit. This gives the yarn the required bulkiness or fluffiness, also referred to as texturizing. The yarn coming out of the draw roller is called as textured yarn. The yarn is then passed through interlacing jets to interlace the filaments within the yarn.

In order to make separable texturized yarns, two or more texturized yarns are wound/plied/grouped together in a single bobbin after passing through an interlacing process. Since the filaments of each yarn are interlaced, each yarn ply gets separated resulting in multi-ply separable textured yarns.

On an industrial scale the textured yarns are produced on a textured machine. In a texture machine there are "X" number of spindles, and "X" number of textured packages are formed at a time if no plying is done. When, plying is done for making multi-ply separable texturized yarns, the number of packages formed at a time is "X" divided by the number of plies. If "n" ply separable textured yarns are made having "d" denier of ply yarns, then the number of textured yarn packages that is made is X/n. This requires "X" number of filament yarn packages and the denier of the wound yarn is d*n. However, if one ply breaks, the other remaining ply or plies are also required have to be broken, which makes the industrial process inefficient.

Thus the conventional system and/or method of manufacturing multi-ply separable textured yarn has inherent issues such as low productivity, high production cost per kilogram of yarn of a particular denier, and poor capability produce low/fine and ultra-low/fine denier yarns.

The system/method of manufacturing multi-ply separable textured yarn, in accordance with the present disclosure, aims to resolve issues of low production and low productivity associated with the conventional separable multi-ply yarn manufacturing.

Objects

The object of the present invention is to provide a manufacturing method for the production of multi-ply separable filament yarn and multi-ply separable textured yarn that results in increased production and reduced production cost per kilogram (kg) of yarn of a particular denier.

Another object of the present invention is to provide a manufacturing method for the production of multi-ply separable filament yarn and multi-ply separable textured yarn that enables the production of multi-ply separable low/fine and ultra-low/fine denier yarns using conventional machines.

SUMMARY

In accordance with one aspect of the present disclosure, there is provided a method of manufacturing a separable interlaced filament yarn, the method comprising:

a) passing a polymer melt through a spinning unit to form a plurality of molten streams;

b) cooling the molten streams in a quenching zone to form plurality of polymer filaments;

c) grouping the filaments to form a yarn; and d) passing the yarn through an interlacing means to interlace the filaments within the yarn, to provide a separable interlaced filament yarn, wherein the interlacing of the filaments within the yarn is retained during further processing of the yarn to fabric and in the fabric.

In a preferred embodiment of the present disclosure, a separable interlaced filament yarn is converged with at least one more separable interlaced filament yarn to provide a multi-ply separable interlaced filament yarn.

In accordance with another aspect of the present disclosure, there is provided a method for manufacturing a multi-ply separable textured yarn the method comprising:

i. passing a multi-ply separable interlaced filament yarn through a texturizing unit to form a multi-ply separable draw textured yarn, wherein the multi-ply separable interlaced filament yarn is separable in to at least two separable interlaced filament yarn, wherein the interlacing of the filaments within each separable interlaced filament yarn is retained during further processing of the yarn to fabric and in the fabric.

In one embodiment of the present disclosure, the multi-ply separable interlaced filament yarn is formed by converging at least two separable interlaced filament yarns.

In another embodiment of the present disclosure, the multi-ply separable interlaced filament yarn is formed by converging at least one separable interlaced filament yarn with one at least one multi-ply separable interlaced filament yarn.

In still another embodiment of the present disclosure, the multi-ply separable interlaced filament yarn is formed by converging at least two multi-ply separable interlaced filament yarns.

BRIEF DESCRIPTION OF THE ACCOMPANYING DRAWING

Characteristics and advantages of the subject matter as disclosed in the present disclosure will become clearer from the detailed description of an embodiment thereof, with reference to the attached drawing, given purely by way of an example, in which:

FIG. 1B is a magnified view of the boxed section of FIG. 1A;

Figure 4A:
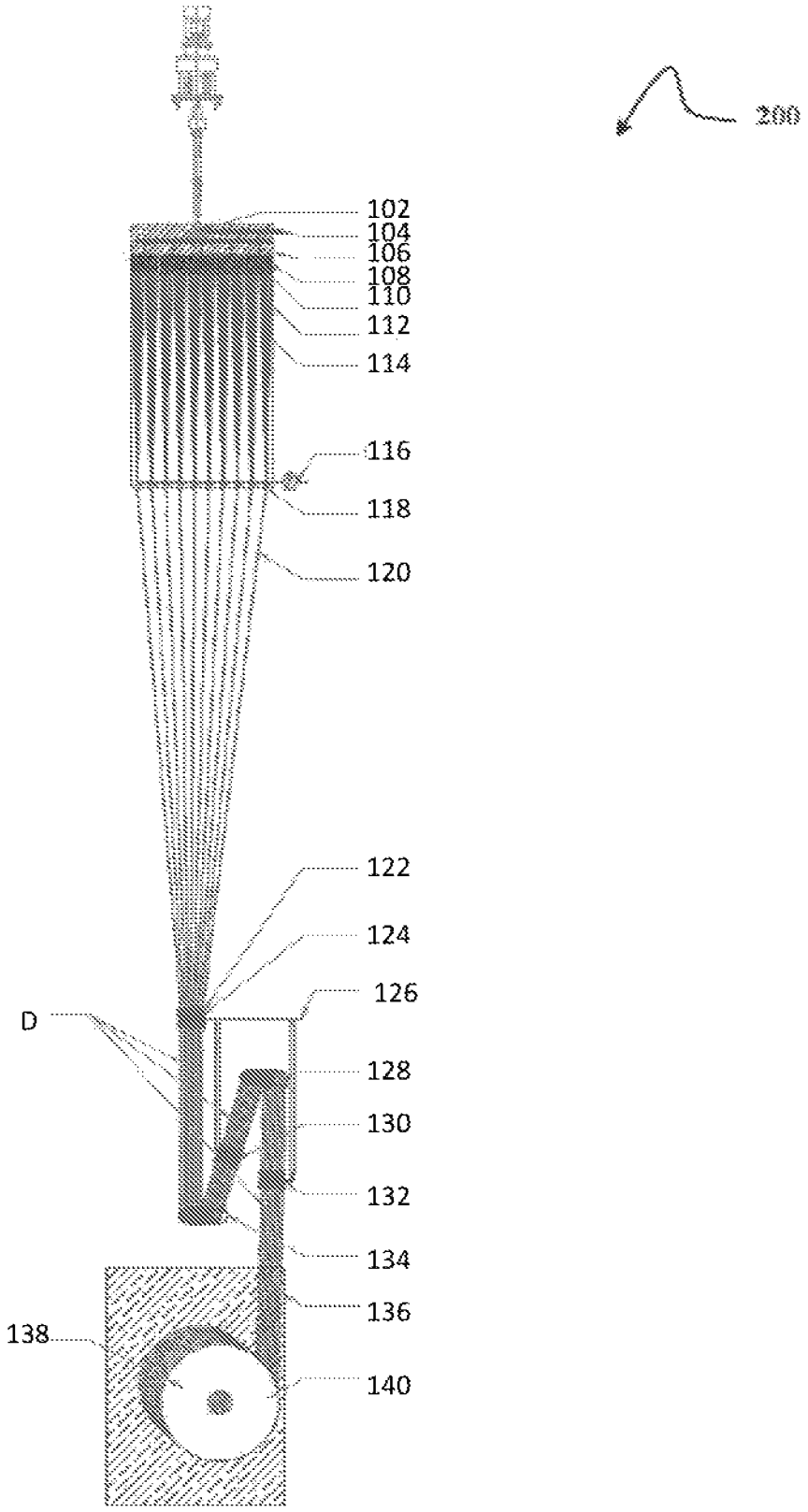
FIG. 4A illustrates an example of manufacturing separable interlaced filament yarn using a system and method in accordance with the present disclosure.
Figure 4B:
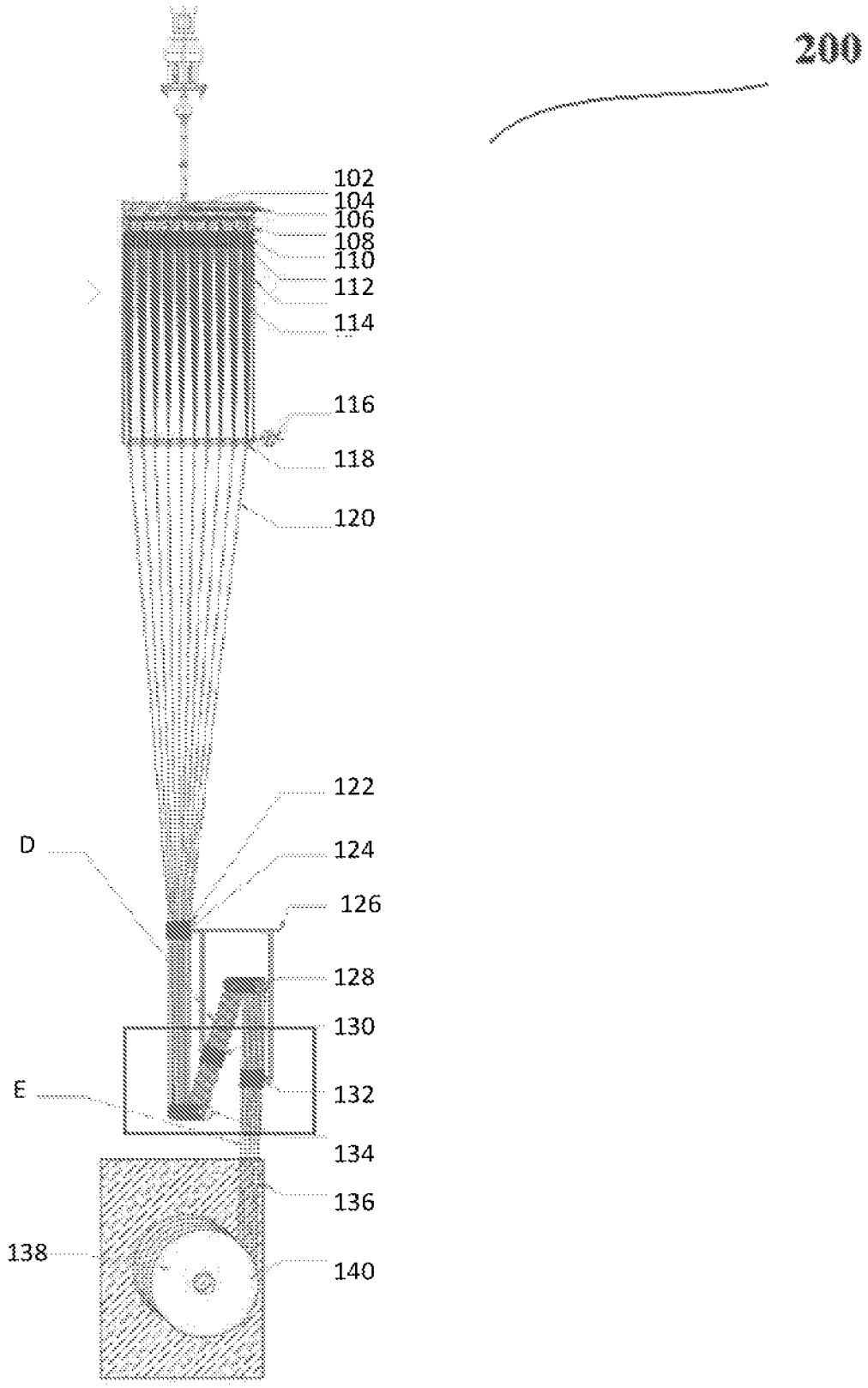
Figure 4C:
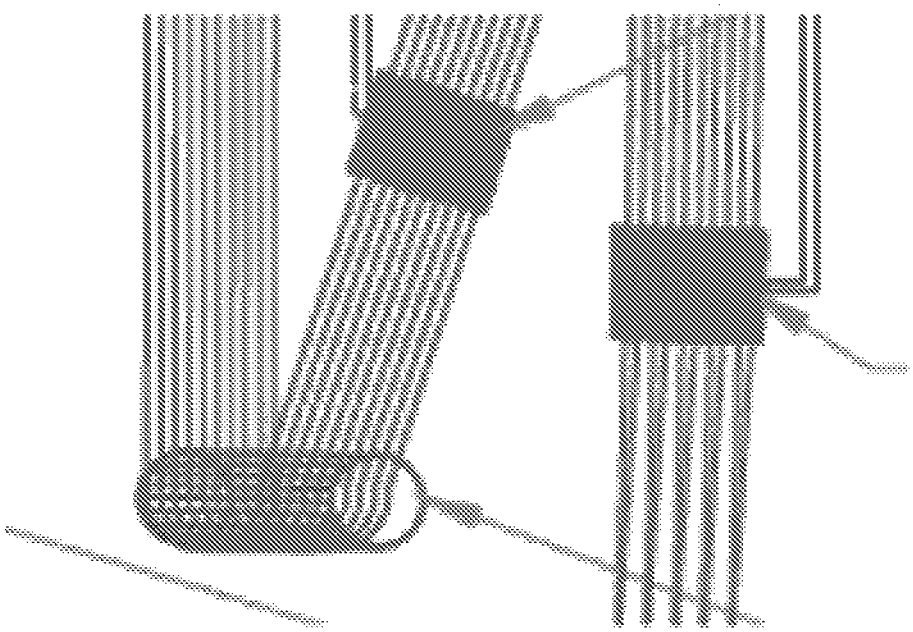
Figure 4D:
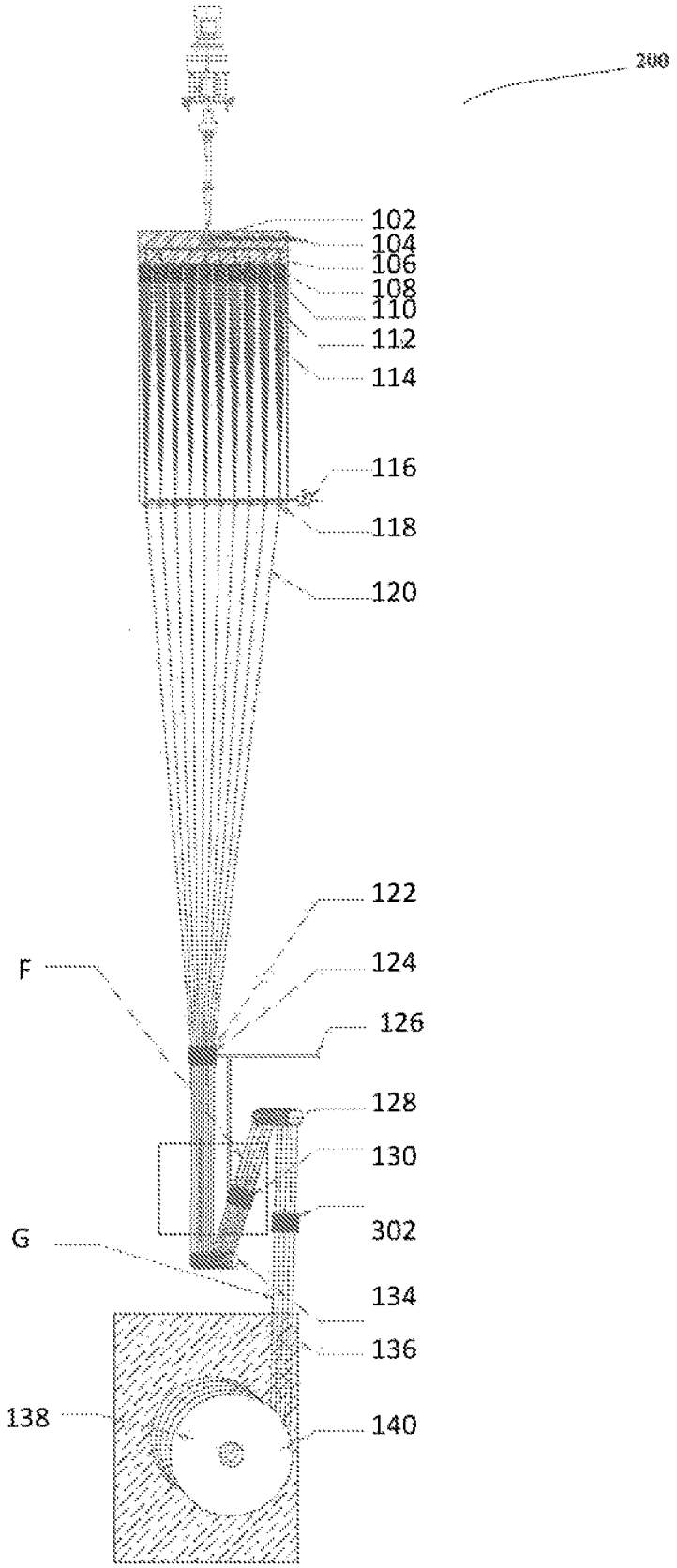
Figure 4E:
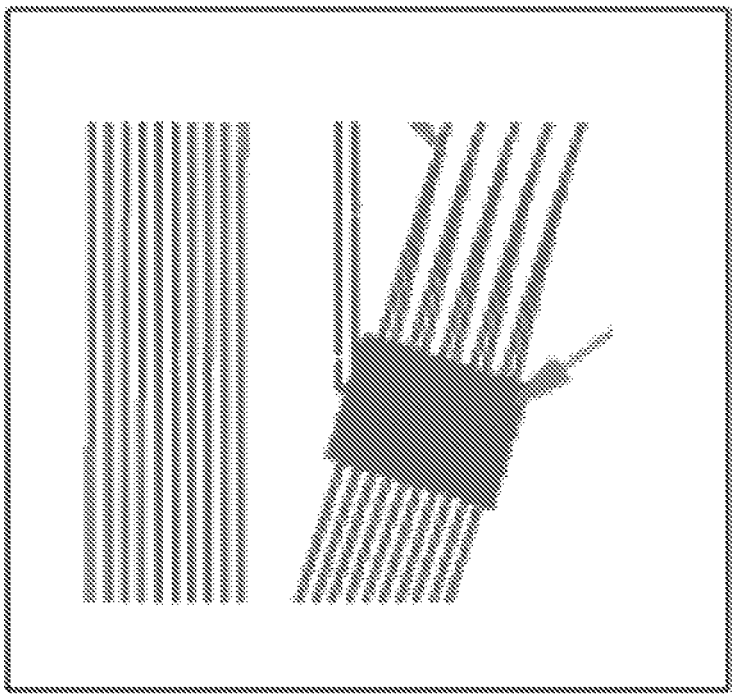
Figure 4F:
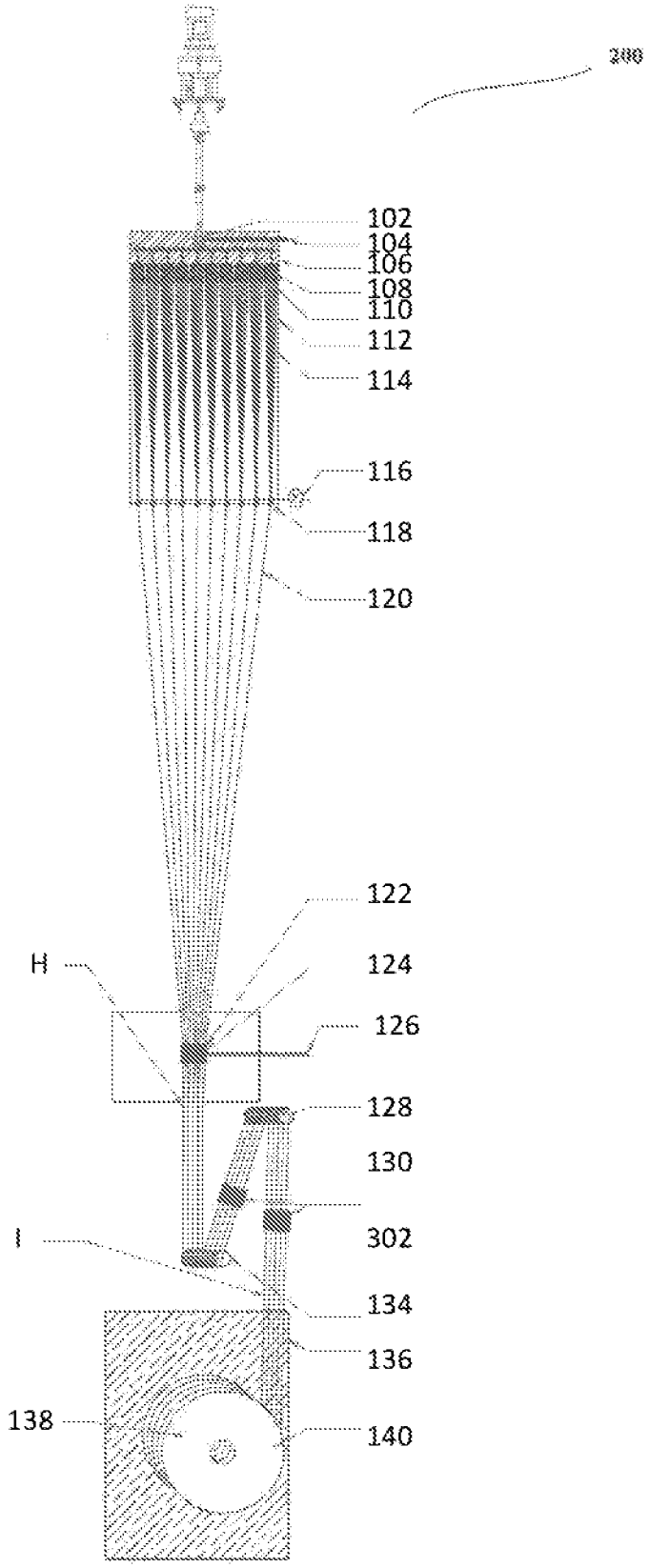
Figure 4G:
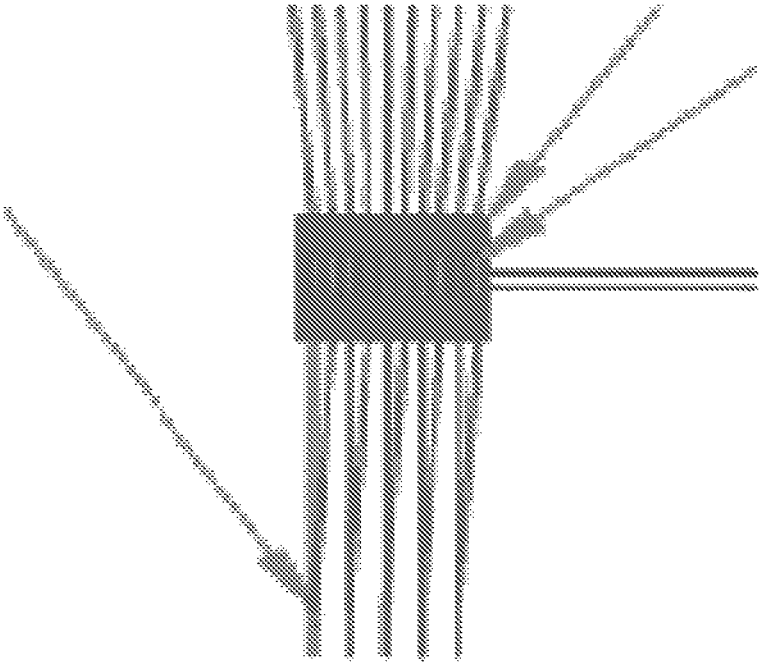
Figure 5A:
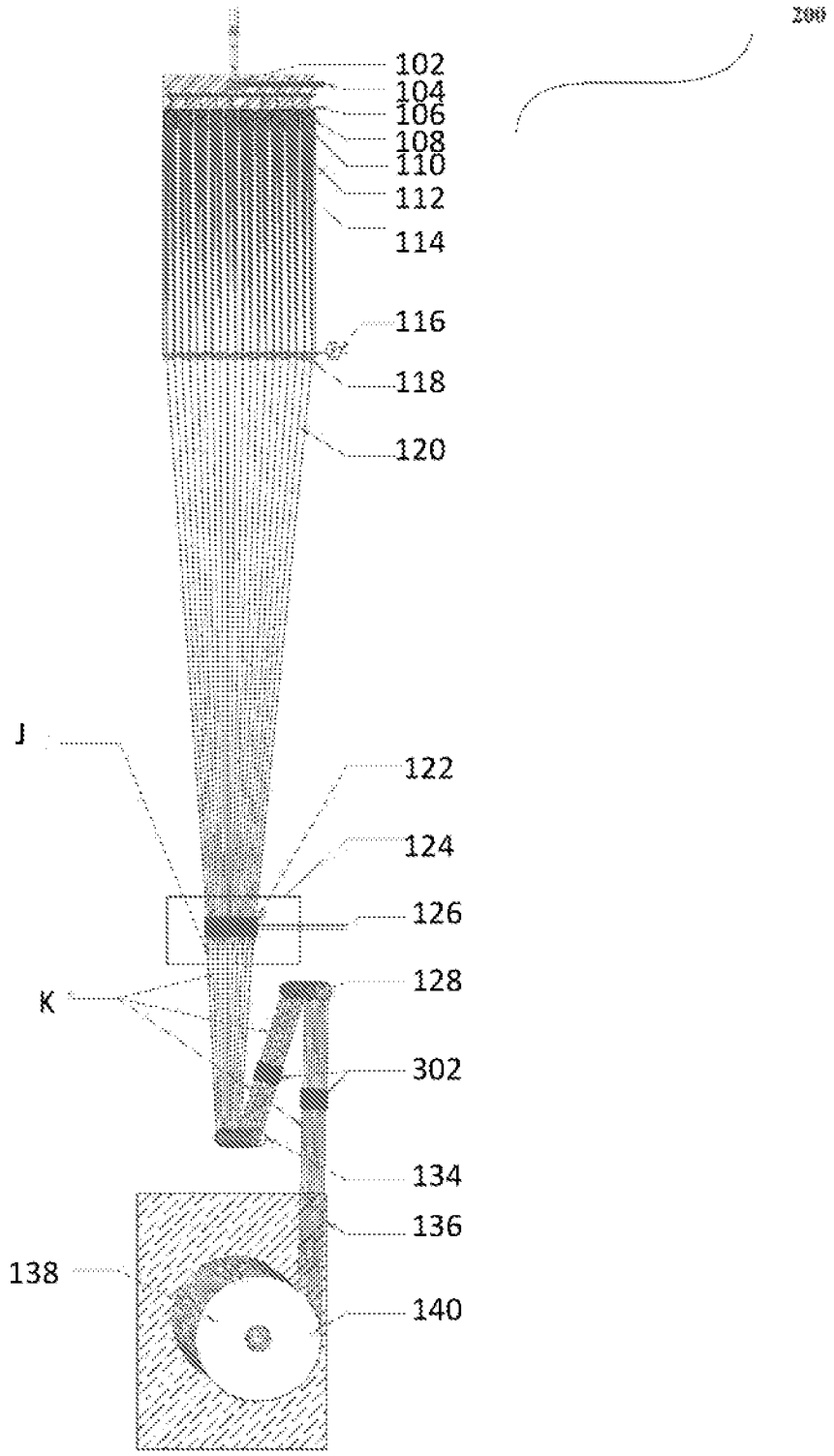
Figure 5B:
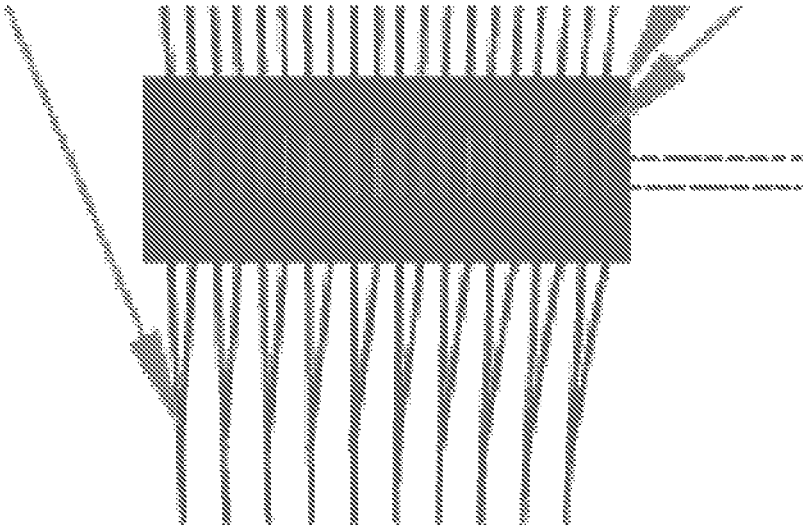
Figure 5C:
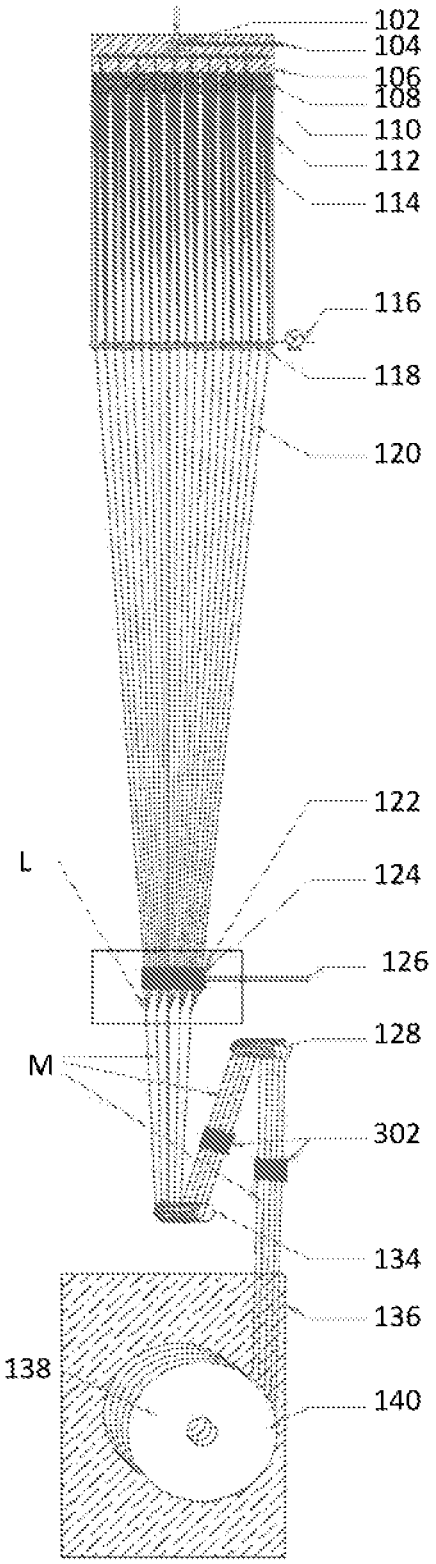
Figure 5D:
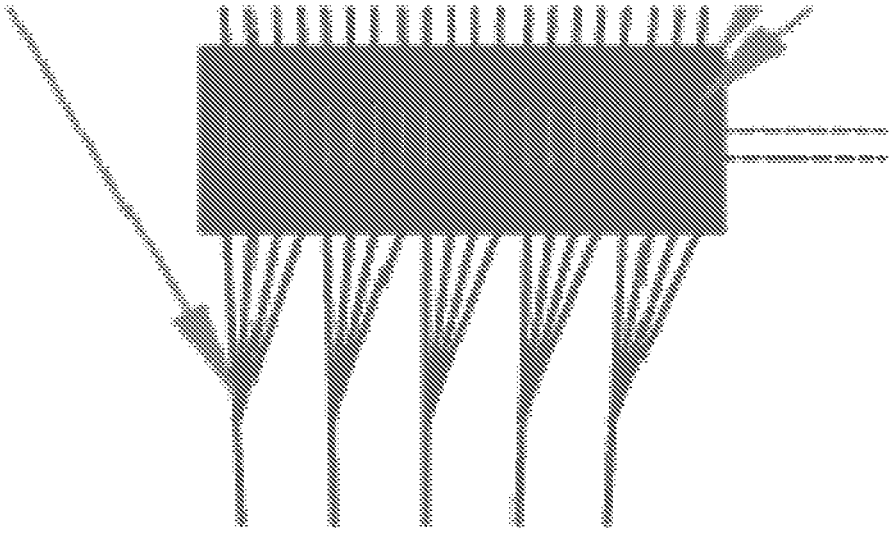
Figure 5E:
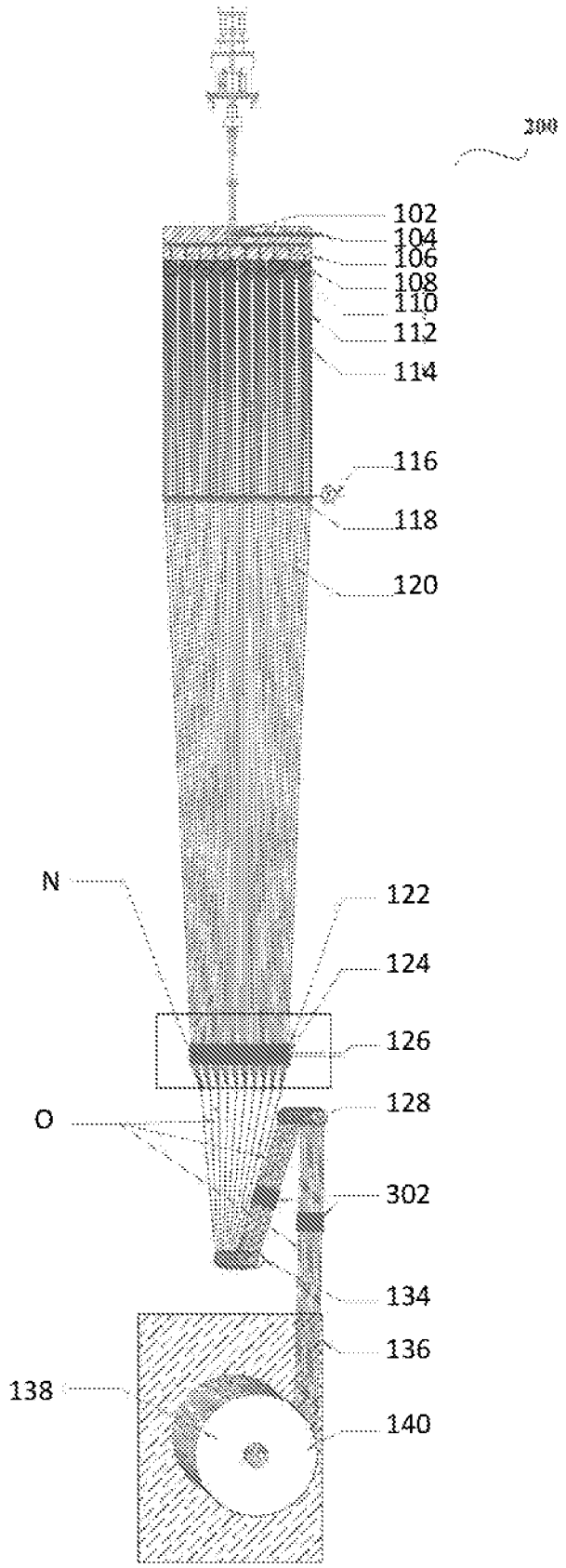
Figure 5F:
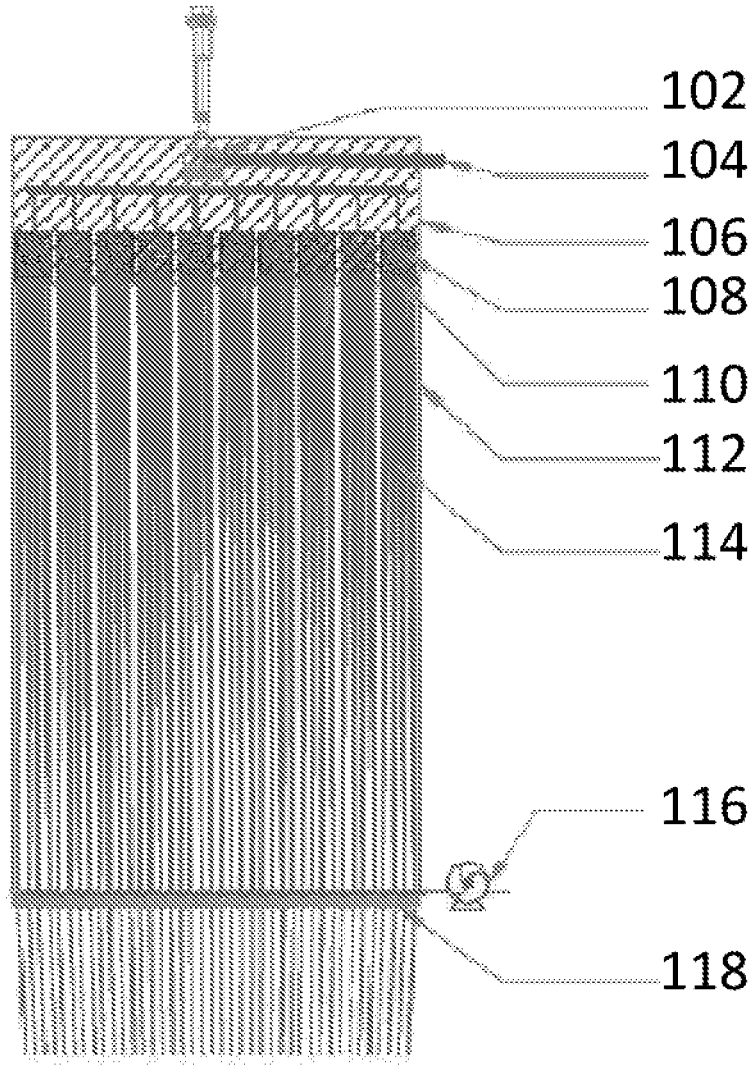
Figure 5G:
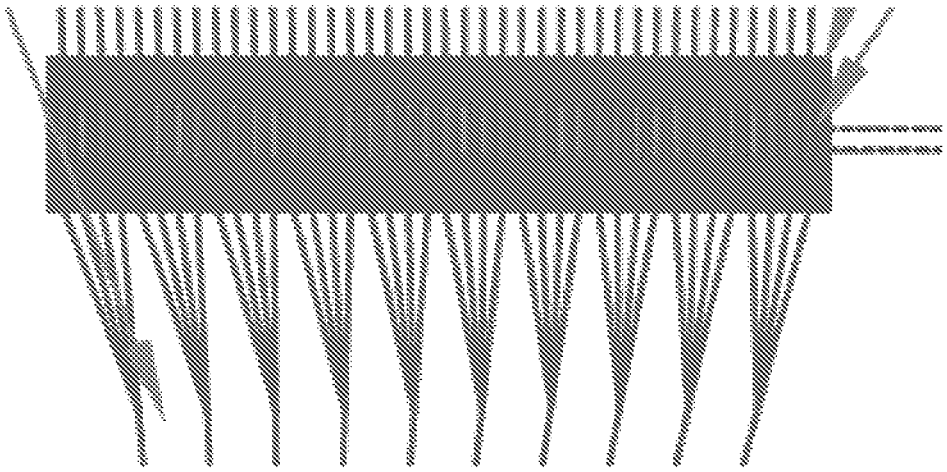
Figure 6A:
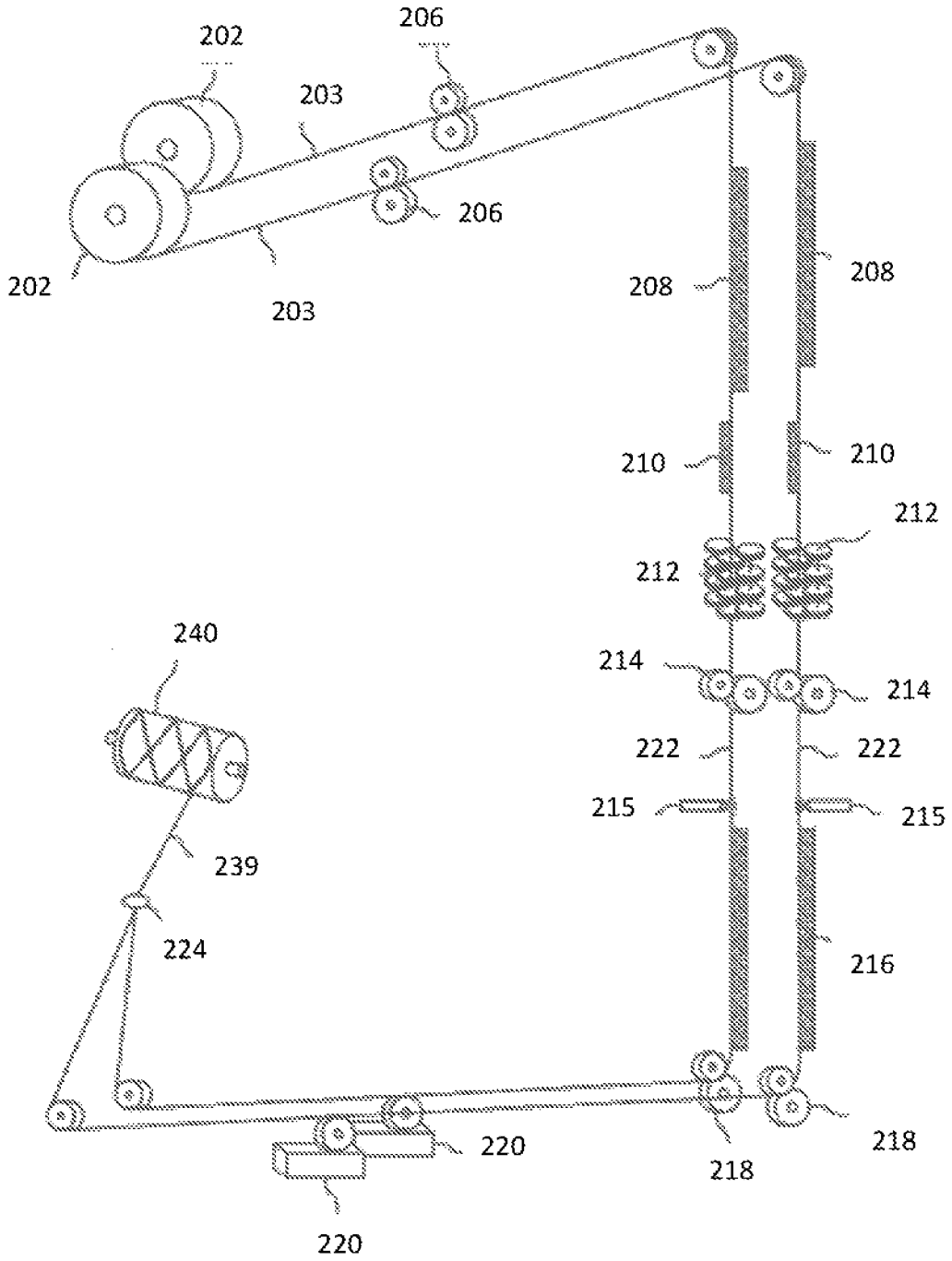
FIGURE 6A (PRIOR ART)
Figure 6B:
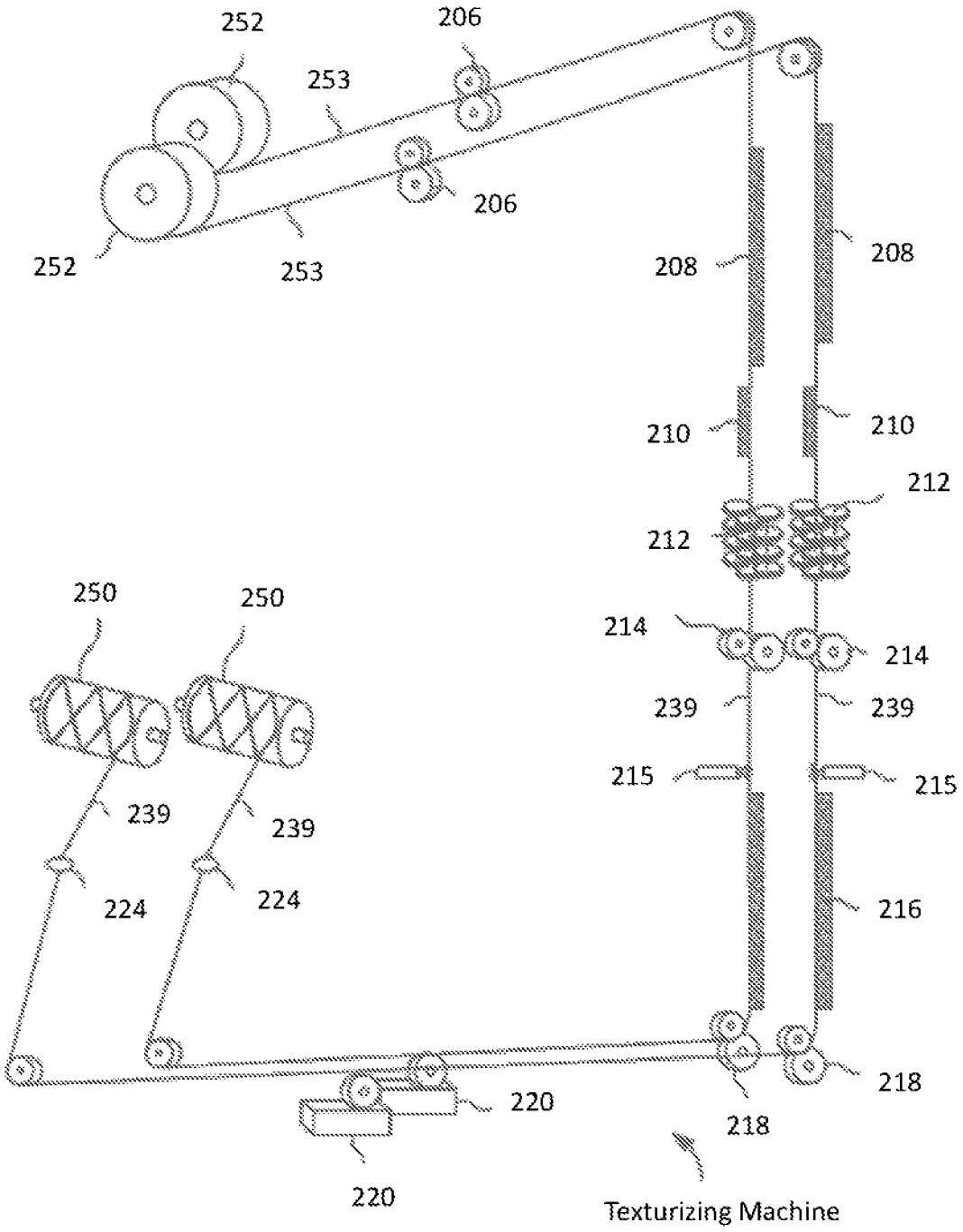
Figure 6C:
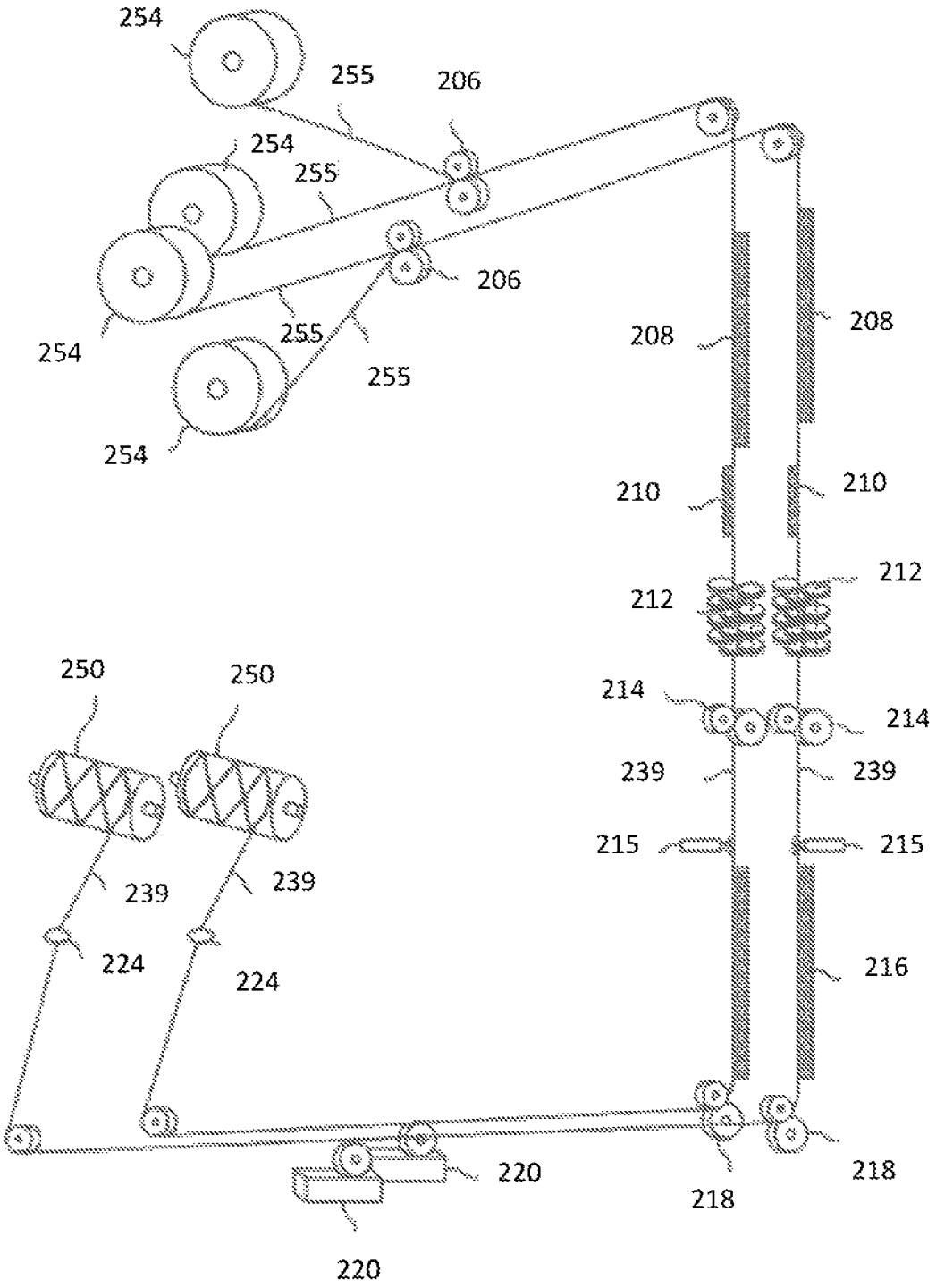

FIGS. 4B, 4C, 4D, 4E, 4F, 4G, 5A, 5B, 5C, 5D, 5E, 5F and 5G illustrate various examples of manufacturing multi-ply separable interlaced filament yarn in a productive manner using a system and method in accordance with the present disclosure, FIG. 4C is a magnified view of the boxed section of FIG. 4B, FIG. 4E is a magnified view of the boxed section of FIG. 4D, FIG. 4G is a magnified view of the boxed section of FIG. 4F, FIG. 5B is a magnified view of the boxed section of FIG. 5A, FIG. 5D is a magnified view of the boxed section of FIG. 5C, and FIGS. 5F and 5G are magnified views of the boxed sections of FIG. 5E;

FIGS. 6A, illustrate an example of manufacturing multi-ply separable textured yarn using a conventional system;

FIGS. 6B and 6C, illustrate an example of manufacturing multi-ply separable textured yarn in a productive manner using a system and method in accordance with the present disclosure; and FIGS. 7, illustrates a significant gain in Output and Capability by using the system and method of manufacturing in accordance with the present disclosure compared to the conventional way.

The present disclosure will now be described with reference to the following non-limiting embodiments.

DETAILED DESCRIPTION

The disclosure will now be described with reference to the accompanying embodiments which do not limit the scope and ambit of the disclosure. The description provided is purely by way of example and illustration.

Figure 1A:
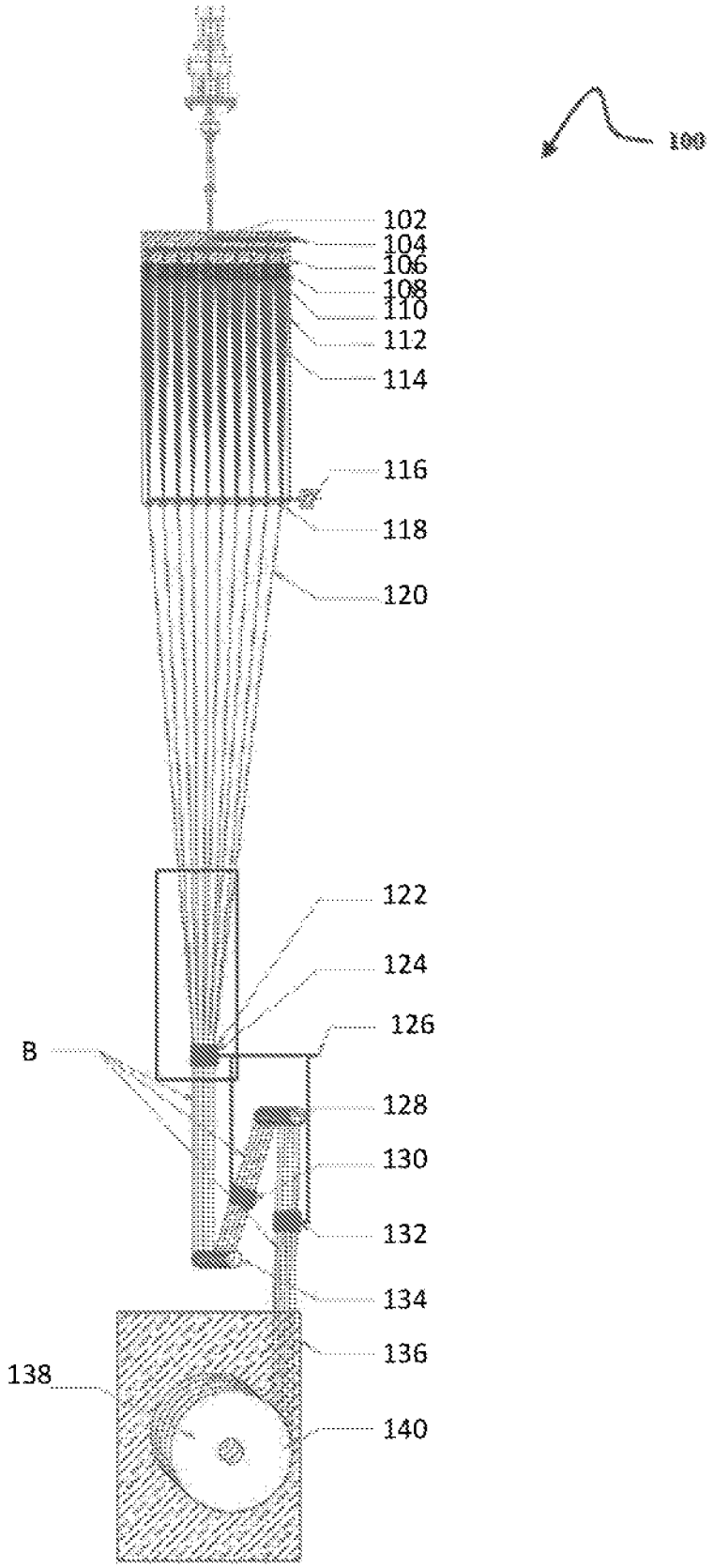
FIGURE 1A (PRIOR ART)
FIGS. 1A, 1B and 2 illustrate examples of conventional filament yarn manufacturing.
Figure 1B:
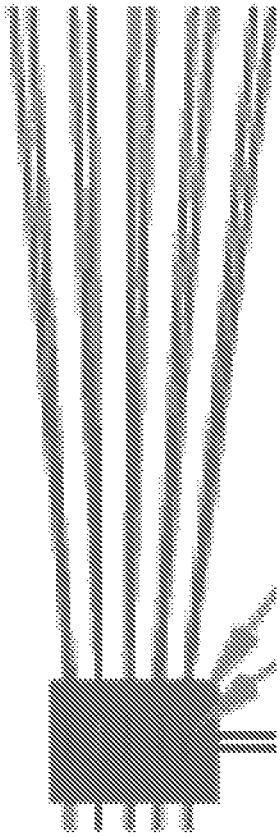
FIGURE 1B (PRIOR ART)
Figure 2:
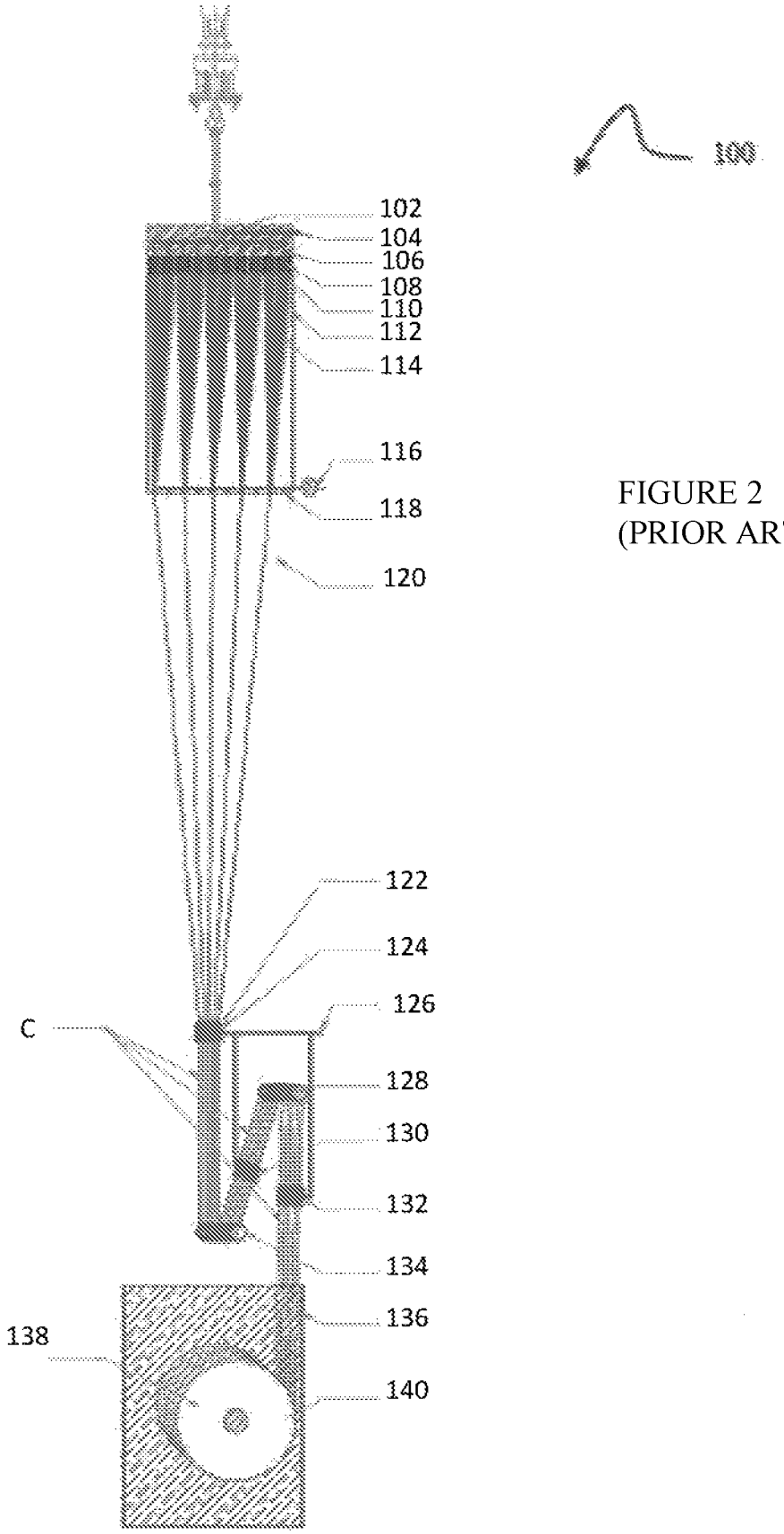
FIGURE 2 (PRIOR ART)

FIGS. 1A, 1B and 2 illustrate conventional method of manufacturing filament yarn, wherein polymer melt is received in a spinning unit (100) via an inlet line (104) and is pressurized or extruded with a melt pump (102) through nozzles (two or more in numbers) in spinnerets (110) placed in a spin pack (108). This results in the generation of two or more polymer filaments (114). These filaments (114) are cooled in a quenching chamber (112) with air in order to solidify. The solidified filaments (114) are bunched in groups of two or more to make a yarn (120).

As shown in the embodiment illustrated in FIGS. 1A and 1B, ten filaments (114) are grouped to make one filament yarn (120). In this way, ten yarns (120) are formed. In this embodiment, there is one spin pack (108) and hence one spinneret (110) for making one filament yarn (120). The filament yarns (120) are passed through spin finish oil applicator (118), spin finish oil is applied on the yarns (120) using a spin finish pump and a spin finish application nozzles to give it oiling/greasing. Spin finish may also be applied using a roller dipped in spin finish oil.

Yarns may also be plied, i.e., multiple yarns wound or grouped together on a single bobbin to increase the denier of each yarn, or increase the filaments per yarn or improve the quality of the yarn. In this embodiment two filament yarns (120) are plied together to form a 2-ply filament yarn. In this way, five 2-ply filament yarns are formed.

The plied yarns are passed through one or more enclosure/device referred to as interlacing/migration/interlacing/comingling/fluid jets/nozzles (124), (130), and (132) ("Interlacing Jet"). In the interlacing jet the filaments of the yarn are subjected to a pressured fluid passed through one or more nozzles from fluid inlet pipe (126), to achieve one or more of the following objects:

Interlacing of filaments with each other;

Comingling of filaments with each other;

Equal distribution of spin finish oil across the yarn;

Knotting of filaments in a yarn.

Binding of filaments in a yarn.

Conventionally, interlacing is carried out at fluid pressure of 1 to 3 bar for filament yarns. Interlacing results in better processing speeds in filament yarn manufacturing, improves bobbin package build, even distribution of spin finish, reduces filaments and yarn breaks.

In FIG. 1A, the interlaced yarns are represented by B. In different embodiments, the number of interlacing jets per yarn may vary in the entire yarn path (nil to many). In FIG. 1A such varying sets of interlacing jets are shown.

When the plied yarns are passed through the interlacing Jet (124, 130, 132) having sufficient fluid pressure, the filaments of the yarn plies intermingle/bind and become a singular yarn, the plies of which are non-separable. In FIG. 1A, non-separable filament yarns are formed as the yarns are plied before interlacing.

The interlaced yarns are passed through separator rollers (also referred to as godets). Preferably, two such separator rollers (128), (134) are provided for good quality of filament yarn. The number of separator rollers, however, may vary depending upon the requirement. The separator rollers help achieve the following objectives amongst others:

Provide stability to yarns and assist drawing or underfeeding or over feeding the yarns;

Adjustment of yarn tension;

Finally, the interlaced yarns are sent to a winder (136) provided with one or more bobbins (also referred to as tubes or cones) (140). Each interlaced yarn is wound around a discrete bobbin. The winder may have a capacity to wind yarn on 10 bobbins at a time. Reference numeral (138) denotes the number of bobbins (140) of yarn wounded in each case.

FIG. 2 illustrate manufacturing of the filament yarns without plying to form filament yarn. In this embodiment, five filament yarns are formed. In this embodiment, the filaments of yarn are subjected to pressurized fluid between 1 to 3 bar in the interlacing jets, resulting in interlaced yarns and are wound directly. In this embodiment, 5 single interlaced filament yarns are wound onto 5 bobbins.

Figure 3A:
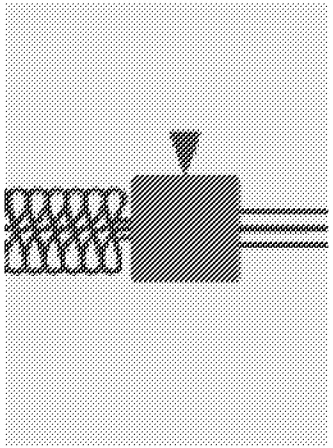
FIGS. 3A, 3B and 3C illustrate various types of interlacing of yarns.
Figure 3B:
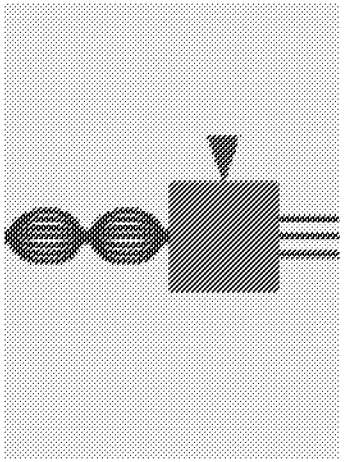
Figure 3C:
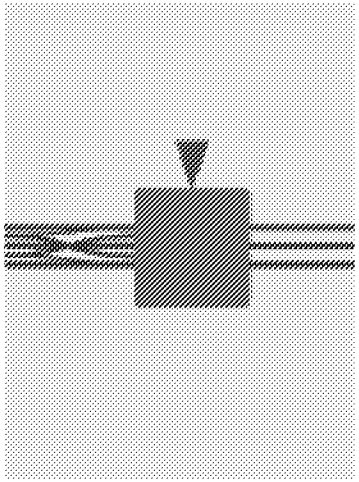

FIGS. 3A, 3B, and 3C illustrate effects of intermingling or interlacing of filaments of a yarn, when the yarn is passed through the interlacing jet having pressured fluid jet. In said Figures, an arrow head represents the flow of pressurized fluid through a nozzle or Interlacing Jet (124), (130), (132), shown as a block. This results in knotting or intermingling or interlacing or comingling or bonding of the filaments of yarn. The intensity or strength of interlacing can be varied with amongst others, the changing of fluid pressure, nozzle diameter and the number of nozzles, nozzle angle, etc.

On an industrial scale, a filament yarn manufacturing system has plurality of winders 136. Production of a filament yarn line is given by the following formula at 100% Efficiency:

Production per day in Kgs per Line=Number of winders*Number of bobbins wound at a time*Denier of wound yarn*Speed (meters per minute-mpm)*60 (min)*24 (hours)/9000000.

It has been found that the multi-ply filaments yarns produced in accordance with the prior art are not separable in to individual yarns after further process like texturizing and in fabric after processing when unplyed or ungrouped.

In the present disclosure, there is provided a method of manufacturing a separable interlaced filament yarn, the method comprising:

a) passing a polymer melt through a spinning unit to form a plurality of molten streams;

b) cooling the molten streams in a quenching zone to form plurality polymer filaments;

c) grouping the filaments to form a yarn; and d) passing the yarn through an interlacing means to interlace the filaments within the yarn, to provide a separable interlaced filament yarn, wherein the interlacing of the filaments within the yarn is retained during further processing of the yarn to fabric and in the fabric.

FIG. 4A illustrate the manufacturing method of separable interlaced filament yarn using method in accordance with the present disclosure.

As illustrated in FIG. 4A, the polymer melt is received in a spinning unit (100) via an inlet line (104) and is pressurized or extruded with a melt pump (102) through nozzles (two or more in numbers) in spinnerets (110) placed in a spin pack (108). This results in the generation of two or more polymer filaments (114). These filaments (114) are cooled in a quenching chamber (112) with air in order to solidify. The solidified filaments (114) are bunched in groups of two or more to make a yarn (120). Ten filaments (114) are grouped to make one filament yarn (120). In this way, ten yarns (120) are formed. The filament yarns (120) are passed through spin finish oil applicator (118), spin finish oil is applied on the yarns (120) using a spin finish pump. The yarns are then passed through one or more enclosure/device referred to as interlacing/migration/interlacing/comingling/fluid jets/nozzles (124), (130), and (132) ("Interlacing Jet"). In the interlacing jet the filaments of yarn are subjected to a pressured fluid passed through one or more nozzles from fluid inlet pipe (126), to achieve one or more of the following objects:

Interlacing of filaments with each other;

Comingling of filaments with each other;

Equal distribution of spin finish oil across the yarn;

Knotting of filaments in a yarn.

Binding of filaments in a yarn.

Interlacing results in better processing speeds in further processing, improves bobbin package build, even distribution of spin finish, reduces filaments and yarn breaks. Separable interlaced filament yarn is formed by interlacing in such a way that the interlacing remains in further processing of yarn and in the facbric. In this figure, separable interlaced filament yarns are represented by D. In different embodiments, the number of interlacing jets per yarn may vary in the entire yarn path.

The interlaced yarns may be passed through separator rollers (also referred to as godets). Preferably, two such separator rollers (128), (134) are provided for good quality of filament yarn. The number of separator rollers, however, may vary depending upon the requirement. The separator rollers help achieve the following objectives amongst others:

Provide stability to yarns and assist drawing or underfeeding or over feeding the yarns;

Adjustment of yarn tension;

Finally, the yarns are sent to a winder (136) provided with one or more bobbins (also referred to as tubes or cones) (140). Each yarn is wound around a discrete bobbin. The winder has a capacity to wind yarn on 10 bobbins at a time. Reference numeral (138) denotes the number of bobbins (140) of yarn wounded in each case.

In one embodiment of the present disclosure, the separable interlaced filament yarn is converged with at least one more separable interlaced filament yarn to provide a multi-ply separable interlaced filament yarn.

FIGS. 4B 4C, 4D, 4E, 4F and 4G illustrate various examples of manufacturing multi-ply separable interlaced filament yarn using a system and method in accordance with the present disclosure.

In relation to the set of FIGS. 4B, 4C, 4D, 4E, 4F and 4G, the structural features of the spinning unit (200), common to the spinning unit (200), are obviated for the sake of brevity. The plying of the filament yarn as illustrated in FIGS. 4B, 4C, 4D, 4E, 4F and 4G is done after passing them through at least one interlacing jet (124, 130, and 132) where the combination of fluid pressure, nozzle size, number of nozzles are used in a way that very strong interlacing (bonding/intermingling/comingling/entangling) between the filaments of a yarn ply takes place and the interlacing does not open during further processing on a texturizing machine and in fabric resulting in separable interlaced filament yarn.

Following are the examples of interlacing done for different denier of Polymers in accordance with the present disclosure the interlacing of which is significantly retained after Texturizing Process and also in the finished fabric:

| Filament yarn denier | Filaments Nos | Filament yarn type | Process speed MPM | Jet nozzle dia mm | Jet fluid pressure Bar g | Jet nozzles Nos | Fluid | Separable filament yarn | Filament yarn avg elongation % |
|---|---|---|---|---|---|---|---|---|---|
| 32 | 14 | Polyester POY | 3000 | 1.2 | 5.0 | 1 | Air | Yes | 135% |
| 32 | 14 | Polyester POY | 3000 | 1.4 | 4.2 | 1 | Air | Yes | 136% |
| 32 | 14 | Polyester POY | 3000 | 1.6 | 4.0 | 1 | Air | Yes | 133% |
| 32 | 14 | Polyester POY | 3000 | 1.2 | 2.0 | 1 | Air | No | 137% |
| 32 | 24 | Polyester POY | 3000 | 1.2 | 3.5 | 1 | Air | Yes | 128% |
| 32 | 24 | Polyester POY | 3000 | 1.4 | 3.0 | 1 | Air | Yes | 128% |
| 32 | 24 | Polyester POY | 3000 | 1.2 | 1.8 | 1 | Air | No | 135% |
| 32 | 24 | Polyester POY | 3000 | 1.4 | 1.6 | 1 | Air | No | 135% |
| 25 | 14 | Polyester POY | 2900 | 1.2 | 4.8 | 1 | Air | Yes | 130% |
| 25 | 14 | Polyester POY | 3000 | 1.4 | 4.2 | 1 | Air | Yes | 129% |
| 25 | 14 | Polyester POY | 3000 | 1.6 | 3.8 | 1 | Air | Yes | 129% |
| 25 | 14 | Polyester POY | 3000 | 1.2 | 2.0 | 1 | Air | No | 135% |
| 25 | 10 | Polyester POY | 3000 | 1.2 | 5.5 | 1 | Air | Yes | 132% |
| 25 | 10 | Polyester POY | 3000 | 1.4 | 5.0 | 1 | Air | Yes | 132% |
| 25 | 10 | Polyester POY | 3000 | 1.2 | 1.2 | 1 | Air | No | 138% |
| 16 | 14 | Polyester POY | 3000 | 1.2 | 4.5 | 1 | Air | Yes | 125% |
| 16 | 14 | Polyester POY | 3000 | 1.4 | 4.0 | 1 | Air | Yes | 124% |
| 16 | 14 | Polyester POY | 3000 | 1.6 | 3.7 | 1 | Air | Yes | 124% |
| 16 | 14 | Polyester POY | 3000 | 1.2 | 1.4 | 1 | Air | No | 128% |
| 16 | 7 | Polyester POY | 3000 | 1.2 | 5.0 | 1 | Air | Yes | 130% |
| 16 | 7 | Polyester POY | 3000 | 1.4 | 4.3 | 1 | Air | Yes | 129% |
| 16 | 7 | Polyester POY | 3000 | 1.4 | 1.2 | 1 | Air | No | 132% |
| 22 | 14 | Polyamide 6 POY | 3750 | 1.2 | 6.0 | 1 | Air | Yes | 55% |
| 22 | 14 | Polyamide 6 POY | 3750 | 1.4 | 5.5 | 1 | Air | Yes | 54% |
| 22 | 14 | Polyamide 6 POY | 3750 | 1.4 | 1.2 | 1 | Air | No | 55% |
| 16 | 12 | Polyamide 6 POY | 3650 | 0.9 | 6.5 | 1 | Air | Yes | 50% |
| 16 | 12 | Polyamide 6 POY | 3650 | 1.2 | 5.5 | 1 | Air | Yes | 51% |

-continued

| Filament yarn denier | Filaments Nos | Filament yarn type | Process speed MPM | Jet nozzle dia mm | Jet fluid pressure Bar g | Jet nozzles Nos | Fluid | Separable filament yarn | Filament yarn avg elongation % |
|---|---|---|---|---|---|---|---|---|---|
| 16 | 12 | Polyamide 6 POY | 3650 | 1.2 | 1.6 | 1 | Air | No | 51% |
| 16 | 07 | Polyamide 6 POY | 3700 | 1.2 | 7.0 | 1 | Air | Yes | 55% |
| 16 | 07 | Polyamide 6 POY | 3700 | 1.2 | 1.8 | 1 | Air | No | 55% |

The above are only examples and the parameters may vary depending on spinning machine, filament yarn type, process speeds, nozzle dia, nozzle angle, fluid used, number of nozzles and various other factors.

In FIGS. 4B, 4C, 4D, 4E, 4F, and 4G, multi-ply separable interlaced filament yarn at various stages are represented by E, G, and I.

In FIG. 4B, there is grouping of two separable interlaced filament yarn represented by "D" between the separator roller (134) and the winder (136), after the interlacing jet (132) to form a 2-ply separable interlaced yarn as represented by "E".

In FIG. 4D, there is a grouping of two separable interlaced filament yarns represented by "F" between two separator roller (128) and (134), after the interlacing jet (130) to form a 2-ply separable interlaced yarn as represented by "G".

In FIG. 4F, there is a grouping of two separable interlaced filament yarns represented by "H" between the quenching chamber (112) and the separator roller (134), after the interlacing jet (124) to form a 2-ply separable interlaced yarn as represented by "I".

In FIGS. 4D and 4F, the migration block (302) is either treated as a 'bypass' block having no or very little fluid pressure. The interlacing jets (124, 130, and 132) can be placed at any location in the entire yarn path between the spinnerets (110) and the winder (136), for example, as shown in FIG. 4B.

In an embodiment, fluid pressure in the interlacing jets (124, 130, 132) may also be increased/decreased and/or a nozzle diameter of the interlacing jet (124, 130, 132) may be increased/decreased to achieve more strong and effective interlacing of the filaments before plying. Due to this, the filaments of one yarn ply do not mix with the filaments of another yarn ply during processing, and results in a multi-ply, separable filament yarn. In each of the cases shown in FIGS. 4B, 4C, 4D, 4E, 4F and 4G, five packages of 2-ply/separable interlaced filament yarns are formed.

With this process, the output of a particular line producing a particular denier of a ply can be increased manifolds by just increasing the number of interlacing jets in the yarn path. The number of spin finish application nozzles (118) may be increased as necessary. The capital investment of doing this is very low compared to the conventional filament yarn manufacturing process. Further, the increased output also results in reduced production cost per kg of yarn of a particular denier. In fact, the more the number of plies of yarns of a particular denier, more the capacity in a single line.

As shown in FIGS. 5A, 5B, 5C and 5D, the output of a particular denier (before plying) at a particular speed is doubled as compared to system shown in FIGS. 4B, 4C, 4D, 4E, 4F and 4G by just doubling the number of the interlacing jet (124, 130, 132) and spin finish application nozzles (118).

In FIGS. 5E, 5F and 5G, the output is quadrupled as compared to the rest. Thus, in accordance with the process of the present disclosure, the output can be made triple or five times or 'x' times. In FIGS. 5A, 5B, 5C, 5D, 5E, 5F and 5G, separable interlaced filament yarn at various stages are represented by K, M and O.

In FIG. 5A, J represents two separable interlaced filament yarn grouped between the quenching chamber (112) and the separator roller (134), after the interlacing jet (124) to form a 2-ply separable yarn represented by "K".

In FIG. 5C, L represents four separable interlaced filament yarn grouped between the quenching chamber (112) and the separator roller (134), after the interlacing jet (124), to form a 4-ply separable interlaced yarn represented by "M".

In FIG. 5E, N represents four separable interlaced filament yarn grouped between the quenching chamber (112) and the separator roller (134), after the interlacing jet (124), to form a 4-ply separable interlaced represented by "O".

In the embodiments as illustrated in the FIGS. 5A, 5B, 5C, 5D, 5E, 5F and 5G, production of ten packages of 2-ply-separable interlaced filament yarn, five packages of 4-ply separable interlaced filament yarn, and 10 packages of 4-ply separable interlaced filament yarn are shown.

Further, by using this method and increasing the output for a multi-ply separable interlaced filament yarn, it would also be possible to make fine and ultra-fine denier yarns up to 3 denier per yarn ply, which is a not possible using conventional technique due to the limitations of a minimum melt pump throughout, high residence time.

In a process for manufacturing multi-ply separable textured yarn using conventional processes (FIG. 6A), a filament yarn package (202) is placed on a filament yarn stand/creel of a texturizing/DTY machine and filament yarn (203) is fed through a primary input roller (206) or feed roller. Through a primary heater (208), the filament yarn is oriented and is passed on a cooling plate (210). The cooled yarn is then passed through a false twist unit (212) having disks in which twisting and de-twisting, also known as false twisting, takes place at high speed. A twist unit is also called as a 'texturizing spindle' and the capacity of such a machine depends on the number of spindles it has. The yarn is further passed through an intermediate roller (214) or a 'draw roller.' The draw roller draws the yarn while it is heated in the primary heater and getting twisted and de-twisted in the false-twist unit. This gives the yarn the required bulkiness or fluffiness, also referred to as "texturize". The yarn coming out of the draw roller is called as DTY or textured yarn (222).

The interlacing (if any) in filament yarn in the conventional method gets majorly opened during the texturing process, as it is very weak. Interlacing of the filament yarn barely remains and not seen in the texturing process. High interlacing is then done on the Texturizing Machine with interlacing/intermingling jets (215) for getting the filaments of yarn interlaced/intermingled/knotted. The yarn is further optionally passed through a secondary heater (216) where the properties of the yarn, such as shrinkage, bulkiness, twist, dyeing, and affinity, are stabilized with the help of an output roller (218). Further, oil is optionally applied through an oiling roller (220) or an oil application nozzle which acts like a grease for the yarn enabling good performance in end uses of yarn. Finally, two or more yarns (222) are grouped/plied to form multi-ply separable textured yarns (239) and wound onto a tube to create an multi-ply separable textured yarn package (240).

In FIG. 6A there are 2 spindles of texturizing machine and a 2 Ply Separable textured yarn package (240) is formed.

The production of a texturizing machine is given by the following formula at 100% Efficiency:

Production per day in Kgs=Number of bobbins wound at a time*Denier of wound yarn*Speed (m/min)*60(min)*24(hours)/9000000.

In a texturized machine if there are "X" number of spindles, then "X" number of bobbins would wound at a time if no plying is done in machine. If plying is done for making multi-ply separable texturized yarns, then the number of bobbins wound at a time is "X" divided by the number of plies 'n'. If 'n' ply separable textured are made having 'd' denier of each ply, then the number of textured yarn package that would be made at a time will be 'X/n'. This would require 'X' filament yarn packages. Further, the denier of the wound yarn would be d*n.

Disadvantage associated with such process is that if one ply breaks, the other remaining ply or plies would also have to be broken, which is not efficient also process speeds are much slower for finer deniers of yarns.

The system/method of manufacturing multi-ply, separable textured yarn, in accordance with the present disclosure, aims to resolve amongst others issues of low production and low productivity associated with conventional yarn manufacturing.

Present disclosure provides a method for manufacturing a multi-ply separable textured yarn, the method comprising:

i. passing a multi-ply separable interlaced filament yarn through a texturizing unit to form a multi-ply separable draw textured yarn, wherein the multi-ply separable interlaced filament yarn is separable in to at least two separable interlaced filament yarn, wherein the interlacing of the filaments within each separable interlaced filament yarn is retained during further processing of the yarn to fabric and in the fabric.

As illustrated in FIG. 6B, 2 spindles of a texturizing machine is having an output 2 packages (250) of 2-ply separable textured yarns (239) by using 2-ply separable interlaced filament yarns (253) from 2 packages (252).

In one embodiment of the present disclosure, the multi-ply separable interlaced filament yarn is formed by converging at least two separable interlaced filament yarn.

As illustrated in FIG. 6C, 2 spindles of a texturizing machine is having an output 2 packages (250) of 2-ply separable textured yarns (239) by using 2-ply separable interlaced filament yarn (253) from 4 packages of separable interlaced filament yarn (252).

As illustrated in FIG. 6C, total 4 packages of separable interlaced filament yarn are used on 2 spindles to form two numbers of 2-ply separable textured yarns. Likewise the output would be of 4-ply separable textured yarns (239) per spindle if two numbers of 2-ply separable interlaced filament yarn (255) would be used for each spindle and output would be 8-Ply separable textured yarns (239) per spindle if two numbers 4-ply separable interlaced filament yarn (255) would be used for each spindle.

The advantage in the present method of yarn manufacturing is due to the strong binding or interlacing of the filaments of each yarn ply of the resulting interlaced separable filament yarn manufactured in accordance with the present disclosure, which does not completely open and remains during the texturizing process and also the fabric after the fabric is made and finished. Further, each ply remains separate after texturizing and even in the fabric. Moreover, unlike the conventional textured yarn manufacturing process, here, it is important not to give high interlacing by interlacing jet (215) on the texturizing machine as all filaments of the plies of the yarn would get intermingled and would not remain separable.

To achieve less interlacing, in the present technique of manufacturing, either the fluid pressure is decreased or the interlacing jet nozzle size is decreased. In a preferred embodiment, interlacing is carried out at fluid pressure up to 1 barg having nozzle size of jet up to 1.4 mm in dia.

The present method results in significant increase in production of textured yarns and results in huge cost saving as compared to the conventional process of plying the yarns in texturizing. Further, the efficiency is more in this process, as a ply breakage does not hamper the whole yarn. Furthermore, increased speeds are used as the denier to be processed per spindle increases.

In one embodiment of the disclosure, at least one multi-ply separable textured yarn is converged with at least one multi-ply separable textured yarn to increase the number of plies and denier.

FIG. 7 illustrates a significant gain in Output and Capability by using the system and method of manufacturing in accordance with the present disclosure compared to the conventional way.

As shown in table in Column 7A1 for producing 20 Denier 2-ply separable interlaced textured yarn using the conventional method, a two 32 denier filament yarns having elongation in range of 125-150 as per conventional process are made at process speed of 3000 MPM and texturized on a texturized machine at draw ratio of 1.7 at process speed of 750 MPM to yield two textured yarn of 20 denier per spindle which are then highly interlaced and finally 2 textured yarns from 2 spindles are wound together on an tube. So an texturizing machine having 312 spindles would get an output of about 748 kgs per day at 100% efficiency as wound denier would be 40 and 156 bobbins would be wound at a time, and filament yarn machine consisting of 1 winder having 10 bobbin winding capacity would give an output of about 153 kgs at 100% efficiency as 10 bobbins would be wound at a time.

Now as using the method as per present disclosure as shown in column 7A2 with reference to FIG. 4A, 10 Bobbins of separable interlaced filament yarn is made by in such a way that the interlacing is very strong and is retained in further process and in fabric. 2 such separable interlaced filament yarn are texturized per spindle, (i.e, 624 yarns) on texturizing machine as shown in FIG. 6C and with an output of 312 packages winding at the same time of 2 ply separable textured yarns and the output is doubled about 1497 kgs as compared to the conventional process.

As shown column 7A3 by using the method as per present disclosure with reference to FIGS. 4B 4C, 4D, 4E, 4F and 4G, 2-ply separable interlaced filament yarn of final denier 64 having two separable interlaced filament yarn of 32 denier. On texturizing machine with reference to FIG. 6B by using this filament yarn on 312 spindles, 20 denier 2-ply separable textured yarn would be wound on 312 tubes at a time and 312 packages would be formed at a time and output of texturize machine would double to about 1497 kgs at 100% efficiency and the same product would be formed. It is very essential that the interlacing on texturizing machine has to be nil or very low as high interlacing would mix the plies and would not result in separable textured yarns.

In column 7A4 in accordance with the present disclosure the filament yarn spinning capacity is doubled as shown with reference to FIG. 5A where the number of jets and other related parts are doubled and the same line will give double production as 20 numbers separable interlaced filament yarn are formed and wound in 2-ply on ten bobbins to form 10 packages of 2-ply separable interlaced filament yarn having final denier of 64. So in 7A4 using the method of the present disclosure filament yarn and texturize production is doubled.

In column 7B1 for producing 20 denier 4-ply separable textured yarns using the conventional method the filament yarn is made using conventional method as in column 7A1. 4 filament yarns are wound together after texturizing in a package resulting in 78 packages formed at a time with winding denier being 80 (20×4). The output remains the same as 7A1. Now using the method as shown in present disclosure with reference to filament yarn produced in column 7A3, yarn from 2 packages of 2-ply separable interlaced filament yarn having total denier of 64 per yarn package is fed to an spindle of texturizing machine with reference to FIG. 6C, total fed denier being 128 per texturizing spindle results in 4-ply separable textured yarns being produced at all 312 spindles at a time and the texturizing production is quadruple compared to conventional way of 7B1.

In column 7B3 with regards to filament yarn, the process as in column 7A4 is carried out except that 20 numbers separable interlaced filament yarn each having denier of 32 are wound in a groups of 4 on the winder using 5 bobbins to create 4-Ply separable interlaced filament yarn having wound denier 128. And in Column 7B4 with reference to FIG. 5E using 40 Jets 40 numbers of separable interlaced filament yarn each having denier of 32 are wound on 10 bobbins to get 4-ply separable interlaced filament yarn in accordance with the present disclosure and output is quadrupled for filament yarn. The filament yarn produced as per column 7B3 and 7B4 is loaded on the texturizing machine as shown with reference to FIG. 6C for one per spindle and at the output is 4-ply separable DTY having total denier. Thus the texturizing production is quadrupled compared to the conventional method as shown in column 7B1.

As shown in column 7C1 for producing 10 denier 4-ply separable interlaced filament yarn, 16 denier of separable interlaced filament yarn would be required. To produce 16 denier yarn, the line output would be about 78 kgs and it is assumed that the line has a minimum capacity of 150 kgs per day. So it would not be possible to produce the filament yarn for 10 denier unless changes are made to reduce its capacity by changing the melt line size, reducing melt pump capacity, reducing residence time, etc. Now by using the method in accordance with the present disclosure for preparing 4-ply separable interlaced filament yarn, the number of interlacing jets is increased to 2 times or 4 times as shown in Column 7C2 with respect to FIG. 5C and Column 7C3 with respect to FIG. 5E respectively and an output for 16 denier 4-ply separable interlaced filament yarn having total denier of 64 denier with each separable interlaced filament having denier of 16. This filament yarn when used on texturizing machine in accordance with the present disclosure as shown in column 7C2 and 7C3 would give an output of 4 times compared to the output possible using conventional method as shown in column 7C1.

Likewise more the number of plies more the output would be possible for a particular denier of yarn. The examples shown are in illustration and figures are with respect to 2-ply and 4-ply. Using the method as per present disclosure it is possible to make any number of plies including 3-ply, 5-ply, 10-ply, 40-ply, 100-ply, etc. and the production would be increasing manifold in texturizing and at filament yarn stage.

The preferred embodiment does not limit the scope and ambit of the disclosure. The description provided is purely by way of example and illustration.

Technical Advancements and Economic Significance

The technical advancements offered by the method of manufacturing yarns disclosed in the present disclosure are as follows:

- Very high output of multi-ply separable filament yarn.
- Very high output of multi-ply separable textured yarns.
- Very high efficiency as compared to conventional system/method in textured and filament yarn.
- Much stable process.
- Increased capability to produce super-fine/low and ultra-fine/low denier multi-ply separable textured yarns.
- Reduction in wastage and increased speeds of processing yarns
- Very low costs of producing multi-ply separable interlaced filament yarn and multi-ply separable textured yarn.
- Very low capital cost involved in increasing output.
- Better quality yarns.
- More plies in multi-ply separable textured yarns.
- Increasing plies in multi-ply separable textured yarn results in decreasing cost instead of increasing cost.
- Highest possible quality of yarns with minimal cost involvement.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

The use of the expression "at least" or "at least one" suggests the use of one or more elements or ingredients or quantities, as the use may be in the embodiment of the disclosure to achieve one or more of the desired objects or results.

Any discussion of documents, acts, materials, devices, articles or the like that has been included in this specification is solely for the purpose of providing a context for the disclosure. It is not to be taken as an admission that any or all of these matters form a part of the prior art base or were common general knowledge in the field relevant to the disclosure as it existed anywhere before the priority date of this application.

The numerical values mentioned for the various physical parameters, dimensions or quantities are only approximations and it is envisaged that the values higher/lower than the numerical values assigned to the parameters, dimensions or quantities fall within the scope of the disclosure, unless there is a statement in the specification specific to the contrary.

The embodiments herein and the various features and advantageous details thereof are explained with reference to the non-limiting embodiments in the following description.

Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

While considerable emphasis has been placed herein on the components and component parts of the preferred embodiments, it will be appreciated that many embodiments can be made and that many changes can be made in the preferred embodiments without departing from the principles of the disclosure.

The foregoing description of the specific embodiments will so fully reveal the general nature of the embodiments herein that others can, by applying current knowledge, readily modifilament yarn and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

The invention claimed is:

1. A group of separable draw textured yarns made by a method, the method comprising steps of:

entering an input of two or more separable interlaced multi-filament yarns into a single spindle of a texturizing unit, each yarn having interlacing strong enough to maintain separability during and after texturizing;

exiting a group of separable draw textured yarns from the single spindle, wherein the group of separable draw textured yarns is separable into the same number of separable draw textured yarns as the number of separable interlaced multi-filament yarns in the input; and winding all the separable draw textured yarn from the group onto a package/bobbin.

2. The group of separable draw textured yarns of claim 1, wherein the denier range of a yarn in the group is 3 to 32, and wherein the filament range of a yarn in the group is 5 to 25.

3. A group separable interlaced multi-filament draw textured yarns, comprising a plurality of separable interlaced multi-filament draw textured yarns, wherein each textured yarn is a group of interlaced textured multiple filaments, wherein the interlacing of the filaments within the textured yarn is strong enough to be retained during further processing of the yarn to fabric and in the fabric so that yarn is separable from other yarns in the fabric, and wherein the denier range of a yarn in the group is 3 to 10.

4. A group of separable interlaced multi-filament draw textured yarns comprising:

a plurality of separable interlaced multi-filament draw textured yarns, wherein each textured yarn is a group of interlaced textured multiple filaments, wherein the interlacing of the filaments within the textured yarn is strong enough to be retained during further processing of the yarn to fabric and in the fabric so that yarn is separable from other yarns in the fabric, wherein the group of separable draw textured yarns is made by the method of entering an input of two or more interlaced multi-filament yarns into a single spindle of a texturizing unit and exiting the same number of separable draw textured yarns as the number of interlaced multi-filament yarns in the input, wherein the denier range of a yarn in the group is 10 to 32, wherein the filament range of a yarn in the group is 5 to 25, and wherein the nips/interlaces per meter of a yarn in the group is 5 to 25.

* * * * *